United States Patent [19]

Gillum

[11] 4,311,081

[45] Jan. 19, 1982

[54] DUAL, TWO STAGE SHELL FEEDING APPARATUS FOR GUNS

[75] Inventor: Richard R. Gillum, Marblehead, Ohio

[73] Assignee: ARES, Inc., Port Clinton, Ohio

[21] Appl. No.: 118,763

[22] Filed: Feb. 5, 1980

[51] Int. Cl.[3] ..... F41D 10/32

[52] U.S. Cl. ..... 89/33 SF; 89/33 BA

[58] Field of Search ..... 89/33 SF

[56] References Cited

U.S. PATENT DOCUMENTS 3,608,424 9/1971 Wiese ..... 89/33 SF 3,683,743 8/1972 Stoner ..... 89/33 SF

*Primary Examiner*—Stephen C. Bentley

*Attorney, Agent, or Firm*—Allan R. Fowler

[57] ABSTRACT

Dual shell feeding apparatus for automatic guns having two shell supplies adapted for holding different types of shells, comprises a shell feeding rotor formed with first and second sets of three peripheral shell holding cavities each, the cavities being arranged in alternating relationship at 60° intervals. The rotor is rotatably mounted between the two shell supplies and a shell pick up position of the gun in a manner causing, when one of the shell holding cavities of either cavity set is in the shell pick up position, another cavity of the same cavity set is in shell receiving relationship with the corresponding one of the shell supplies, shells being fed from one of the supplies by one of the rotor cavity sets when the rotor is selectively rotated in one direction and from the other supply by the other cavity set when the rotor is selectively rotated in the opposite direction. Second stage shell feeding tracks associated with each of the shell supplies are configured for transferring shells into the rotor from the selected supply after first stage shell transferring rotor rotation and before the next firing.

24 Claims, 29 Drawing Figures

FIG. 11a.
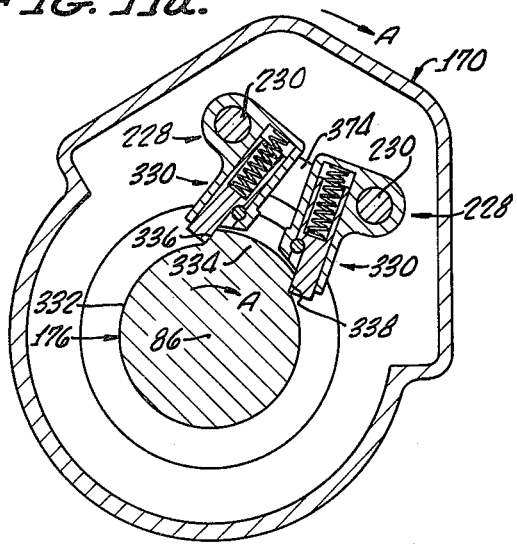
FIG. 11b.
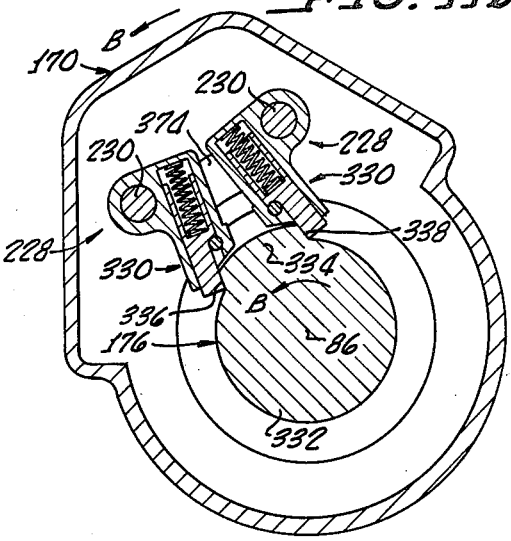
FIG. 12a.
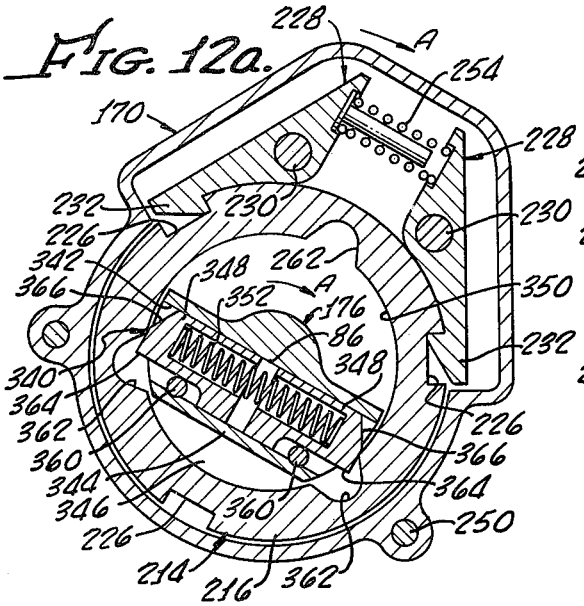
FIG. 12b.
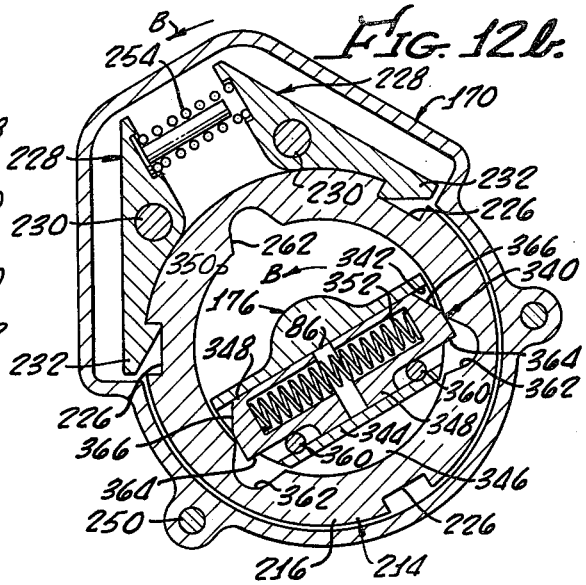
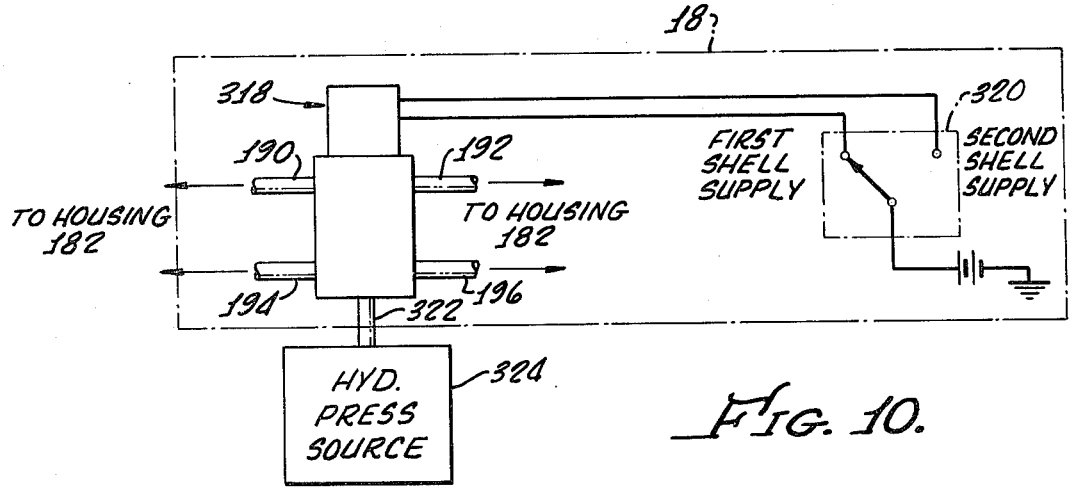
FIG. 10.

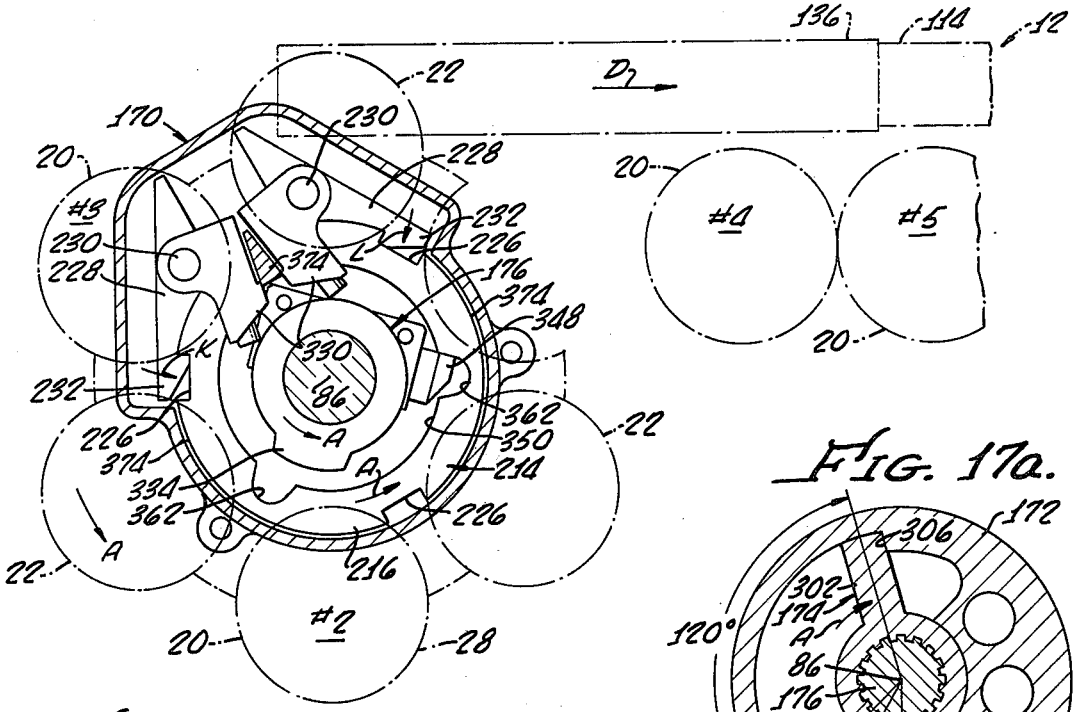
FIG. 17b.
FIG. 17a.
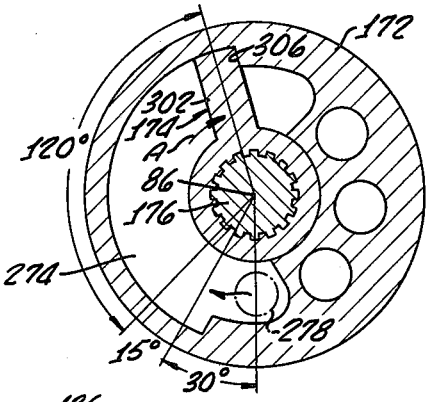
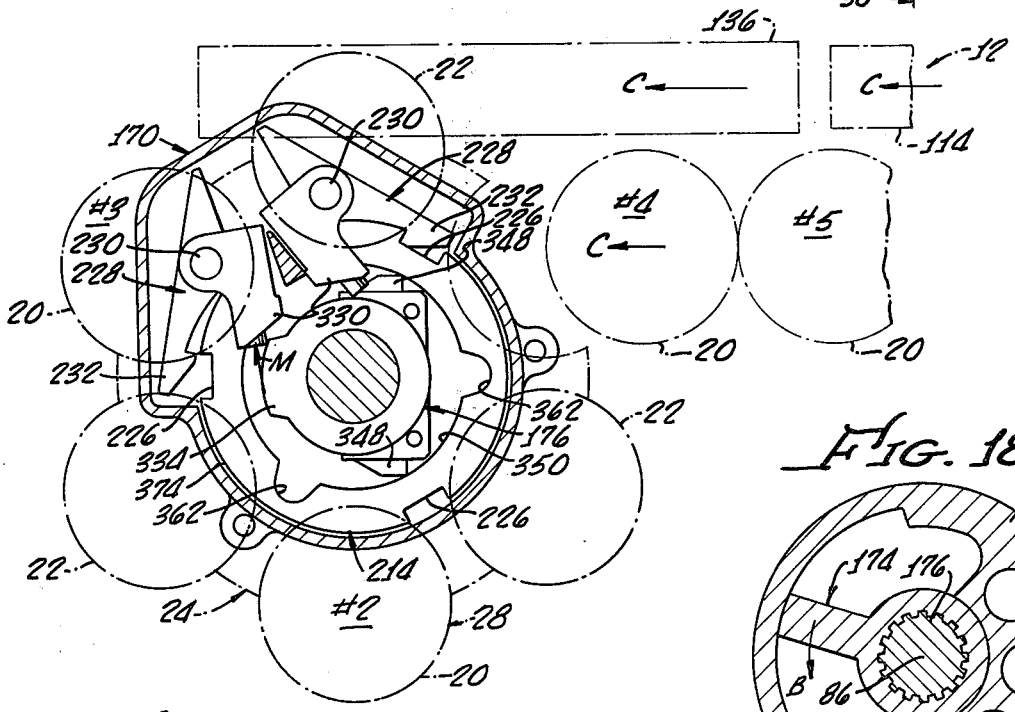
FIG. 18b.
FIG. 18a.
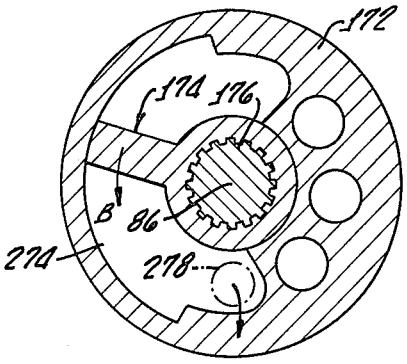

DUAL, TWO STAGE SHELL FEEDING APPARATUS FOR GUNS

The present invention relates generally to the field of rapid firing cannon, and more particularly to shell feeding apparatus for automatic cannon having dual shell supplies.

An extremely difficult role in modern warfare is defending targets against low level, relatively close-in attack by enemy aircraft. Because of difficulty in detecting fast, low flying attack aircraft at sufficiently great distances to enable effective use of modern surface-to-air missiles, this critical defensive role is very often assigned to antiaircraft weapons system incorporating rapid fire, automatic cannon.

Although maximum range for the calibre cannon—typically 30–40 mm—most commonly used for close-in air defense purposes is on the order of 5000 meters, the most effective range against low level, mach 1 attacking aircraft has generally been found to be between about 1000–3000 meters. At such range, attacking aircraft can seldom be tracked for more than a few seconds during each attack pass; therefore, to provide an effective defense, high firing rates are essential.

As a result, automatic cannon used for close-in air defense are typically configured to have instantaneous firing rates of several hundred rounds per minute; although, the cannons are normally fired only in short, 10–20 round bursts to conserve ammunition. As specific example, gas operated, single barrel 35 mm antiaircraft cannon typically have maximum firing rates of about 500–600 rounds per minute, being usually mounted in pairs for increased fire power.

Given the general use of gas operated cannon for close-in air defense roles, due to deficiencies of other types of automatic cannon, improvements increasing firing rates of individual cannon, or improving reliability at existing firing rates, are essential to counteract continually improved performance and increased sophistication of attacking aircraft and their weaponry.

Because most commonly used antiaircraft cannon operate on an axially reciprocating bolt principle, in which shell loading and firing occur on a forward or counterrecoil bolt stroke and fired shell casing extraction and ejection occur on a rearward or recoil bolt stroke, firing rates are directly related to bolt cycling time. As a consequence, any increase in firing rate requires a corresponding decrease in bolt cycling time, either by increasing bolt speed, by reducing length of the bolt stroke or by doing both.

It necessarily follows that as bolt speed is increased and bolt stroke is decreased to increase firing rate, allowable shell feeding time is decreased, as is length of the shell feeding path after shell pick up by the bolt on counterrecoil. Accordingly, problems with reliable feeding of shells ordinarily limit firing rates of automatic cannon, shell feeding improvements being usually necessary to further increase firing rate of these weapons or to enhance firing reliability at existing firing rates.

As an example of such shell feeding improvements, my copending patent application, Ser. No. 06/089,308, filed on Oct. 30, 1979, discloses for automatic cannon, an improved, two stage shell feeding apparatus which includes a rotor having a plurality of peripheral shell holding cavities, rotatably disposed between a shell supply and a shell pick up or loading position of the associated cannon. Immediately upon firing of the cannon, within about 25 percent of the bolt cycling time, the rotor is rapidly rotated a partial turn to index a rotor cavity held shell into the pick up position, thereby rotatably transferring a shell into position to be picked up on bolt counterrecoil. The remaining, longer portion of the bolt cycling time is available for the generally slower second step or stage of advancing shells in the shell supply one position to transfer a shell from the supply into an aligned empty rotor cavity. Thus, reliable shell feeding at high firing rates necessary for effective antiaircraft cannon is enabled.

A second, but often still critical, function required of most close-in antiaircraft cannon systems is defense (or offense) against enemy ground targets. For example, such cannon may also be required to provide defense against enemy ground attack by tanks, in addition to the primary role of defending friendly targets against air attack. Because of this duality of roles, and since such different targets as aircraft and tanks require different types of ammunition, rapid availability of at least two different types of ammunition is required, being typically specified in procurement contracts.

In some types of antiaircraft gun systems, ammunition is stored in drums having rotatably mounted, power driven segments which can be loaded with different types of ammunition for different targets. By electrically selecting appropriately loaded drum segments, different types of shells can be fired, according to the target presented. When using such drum magazines, all the various types of shells available are fed from the common drum through a common feed port. Thus, a single, two stage feeder of the type disclosed in my above-identified copending application is capable of rapidly feeding differently selected types of shells to the associated cannon.

However, many types of automatic cannon weapon systems are configured with two separate ammunition supplies for each cannon. If the primary role of the weapons system is air defense, one ammunition source ordinarily provides a large supply of high explosive shells required for use against attacking enemy aircraft. The second, typically smaller, ammunition source provides armor piercing shells for use against armored vehicles such as tanks. Typical of such systems is the system disclosed in the U.S. Pat. No. 3,683,743 of Stoner.

As exemplified in such patent, this type of dual feed gun typically provides for manual selection between the two ammunition sources. The manual selection may, for example, move portions of the selected source into shell feeding relationship with the cannon.

There still exists, however, problems, particularly for larger calibre cannon used in antiaircraft systems, related to feeding shells from either source selected sufficiently rapidly to enable the requisite high instantaneous firing rates. These problems, as described in my above-identified copending application, relate to difficulties in advancing a number of relatively heavy shells rapidly enough between shots to assure a shell in stably positioned in the shell pick up position when the bolt reaches the pick up position on counterrecoil.

Accordingly, I have invented a dual, two stage shell feeding apparatus for automatic cannon and the like which provides for reliable and rapid, two stage shell feeding from either of two separate ammunition supplies by a bidirectionally rotatable rotor disposed between both ammunition supplies and a shell pick up position of the cannon.

Accordingly, dual, two stage shell feeding apparatus, for guns, such as automatic cannon, having associated, spaced apart first and second shell supplies and a shell loading position, comprises a first stage shell transfer rotor having means defining a plurality of peripheral shell holding cavities a first set of rotor cavities, comprising a plurality, such as three, of first shell holding cavities, is provided for transferring shells from the first shell supply to the loading position and a second set of cavities, also comprising a plurality of cavities, the first and second sets of cavities preferably each containing the same number of cavities, is provided for transferring shells from the second shell supply to the loading position. The first and second shell holding cavities are alternately arranged around the rotor at equal (for example 60°) angular spacings. Means are provided for rotatably mounting the rotor between the first and second shell supplies and the shell loading position to enable rotational transfer of shells from either selected one of the shell supplies to the shell loading position. The mounting means mounts the rotor, relative to the first and second shell supplies and the shell loading position, to cause, whenever one of either set of the rotor cavities is in shell receiving relationship with the selected one of the shell supplies, another one of the cavities in the same set of cavities to be in the shell loading position. From the loading position, the shells are picked up, for example, by an axially reciprocating bolt, loading into a gun breech and fired.

Included in the dual, two stage shell feeding apparatus are means for rotatably indexing the rotor in one rotational direction to transfer shells from the first shell supply to the shell loading position for picking up and firing, and in an opposite rotational direction to transfer shells from the second shell supply to the shell loading position. Second stage shell feeding means are provided for transferring shells from the selected shell supply into the corresponding set of rotor cavities between each firing of the gun.

Configuration of the rotor and the rotor mounting means enables, whenever one of the first rotor cavities is indexed into the shell loading position, another one of the first cavities to be positioned in shell receiving relationship with the first shell supply, and whenever one of the second rotor cavities is indexed into the shell loading position, another one of the second rotor cavities to be positioned in shell receiving relationship with the second shell supply.

During firing of the gun, the second stage shell feeding means causes, according to the shell supply selected for feeding the gun, transferring of a shell from the first shell supply into the rotor whenever an empty one of the first rotor cavities is in shell receiving relationship with the first shell supply and from the second shell supply into the rotor whenever an empty one of the second rotor cavities is in shell receiving relationship with the second shell supply.

To enable selection between feeding the gun from either of the two shell supplies, for example, to enable effective firing at different types of targets, selecting means are provided for selecting between the sets of shell holding cavities to be used for shell feeding. Such selecting means cause partial rotation of the rotor, before firing the gun, through a rotational angle equal to the angular spacing between the rotor cavities, to position one of either the first or second shell holding rotor cavities in the shell loading position and another of the same set of cavities in shell receiving relationship with the corresponding shell supply.

Since rotational indexing direction of the rotor, during firing, is in opposite directions for feeding from each of the supplies, to enable maintaining a fully loaded shell rotor whenever firing is stopped, in turn enabling rapid shifting between shell supplies, the selector means is also configured for simultaneously, prefiring setting of the direction the rotor is to rotate during firing.

Selective prefiring rotor indexing to choose between the shell supplies for feeding the gun and to set direction of rotor rotation during firing, as well as rotor shell transfer indexing during firing is provided by rotor rotational direction control and rotor drive means connected to the rotor.

Comprising the rotor control and drive means are bidirectional first, second and third rotary pistons and a shaft extension fixed to a rotor mounting shaft. The first and second pistons are rotatably mounted around the shaft extension and the third rotary piston is fixed to the shaft extension. Means are provided for releasably interconnecting the first rotary piston to the rotor so that prefiring selective actuation of such piston, from a pressurized fluid source, causes the extent of rotor indexing required for cavity shell feeding selection, and hence shell supply selection. Because of rotor interconnection with the third rotary piston, actuation of the first piston rotates not only the rotor a single cavity spacing, but also indexes the third rotary piston through the same rotational angle.

Prefiring actuation of the second rotary piston, from the pressurized fluid source, causes rotation of a pressure chamber formed in the second piston and into which the third rotary piston is received. Such prefiring rotation of the second piston enables pressurized barrel gas, caused by firing of the gun, to be fed to one side or the other of driving portions of the third piston. This establishes, rotational direction of the third piston, according to shell selected supply selected for feeding the gun, and hence of the shaft extension rotor shaft and the rotor, during firing of the gun.

The means interconnecting the first rotary piston and the rotor includes means locking the rotor to the first piston at each rotor indexing position, to assure reliable shell stripping from the cavity in the loading position. Means, responsive to actuation of the third piston are accordingly also provided for unlocking the rotor from the first piston to enable first stage shell transfer feeding between firings.

Included in the rotor control and drive means are ratcheting means enabling unidirectional stepwise rotor indexing during firing from a selected shell supply in response to reciprocating rotational movement of the third piston, shaft extension and rotor shaft.

Fixed to the rotor shaft are actuating means for the second stage shell feeding means. As a result, the second stage shell feeding means is also responsive to actuation, by pressurized barrel gas, of the third rotary piston. A sliding, shell advancing track, which forms part of the second stage shell feeding means, is pushed away from the rotor towards the selected shell supply by the actuating means in response to rotor shaft rotation during firing of the gun, and as first stage shell feeding by the rotor occurs. When the actuating means is returned with return rotor rotation, drive springs associated with the track and compressed during track actuation drive the track back towards the rotor, thereby advancing a shell into the rotor after the rotor has been indexed to advance a shell into the loading position.

Rapid selection of the shell supply from which the gun is to be fired is thus enabled, when the gun is not being fired, by rotationally indexing, by pressurized fluid, the rotor one cavity spacing to move one of the selected set of rotor shell holding cavities into the shell loading position.

Thereafter, first stage rotor indexing, responsive to firing of the gun, quickly rotates a shell from the shell supply selected by the prefiring rotor indexing into the shell loading position in readiness to being picked up and fired by, a bolt on counterrecoil. After first stage, shell advancing rotor indexing, and before a next firing of the gun, the second stage shell feeding means advances a shell from the selected supply into a rotor cavity emptied when the just fired shell was stripped therefrom for firing.

A better understanding of the present invention may be had from a consideration of the following detailed description, taken in conjunction with the accompanying drawings in which.

Figure 4:
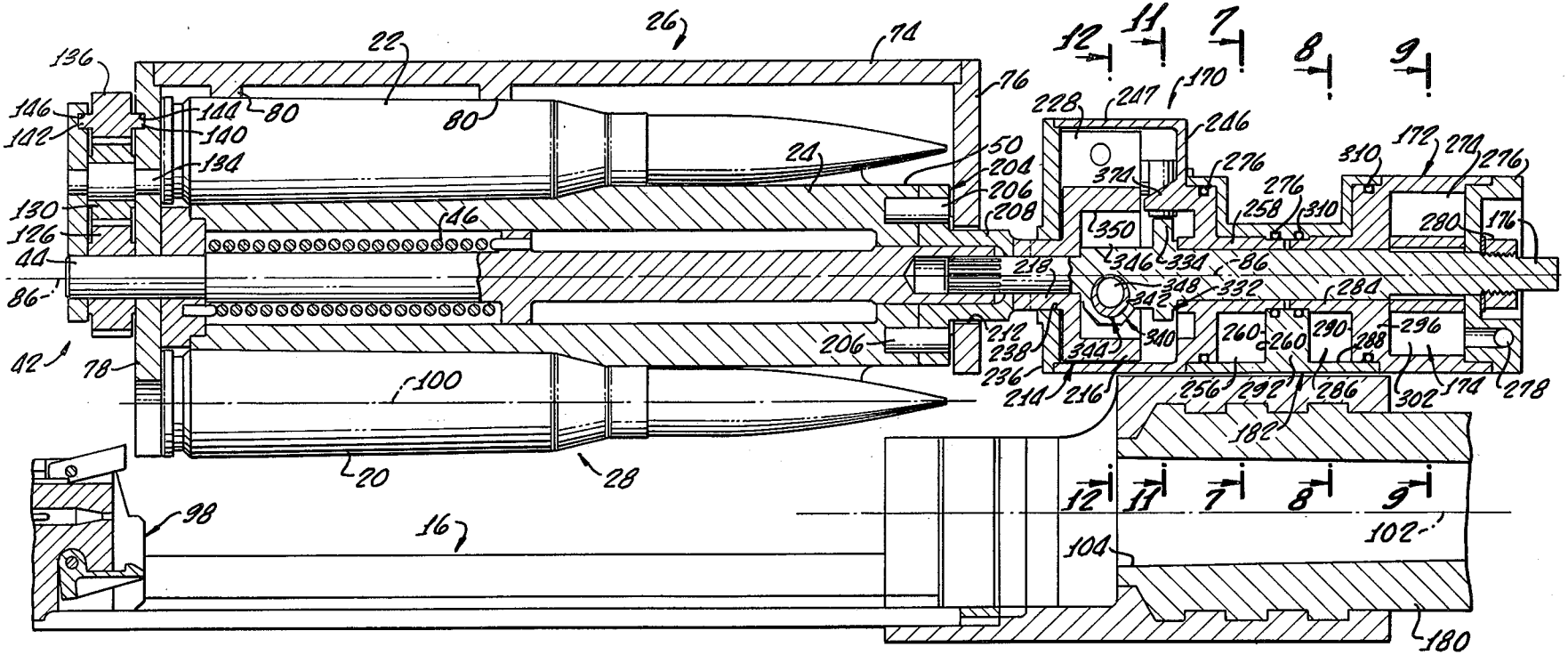
FIG. 4 is a longitudinal cross sectional view, taken along line 4—4 of FIG. 2, showing internal configuration of the rotor directional control and rotor drive means and showing connection thereof to the rotor.
Figure 7A:
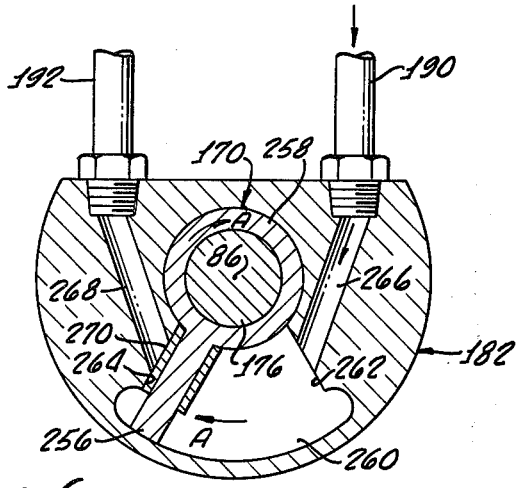
Figure 7B:
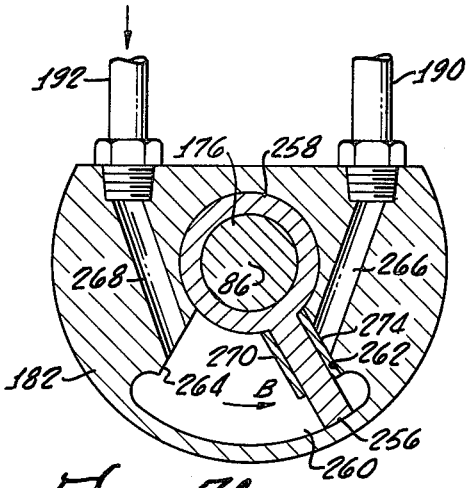
Figure 8A:
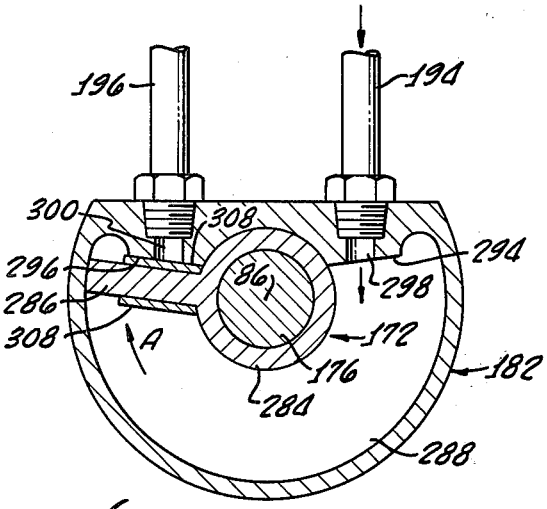
Figure 8B:
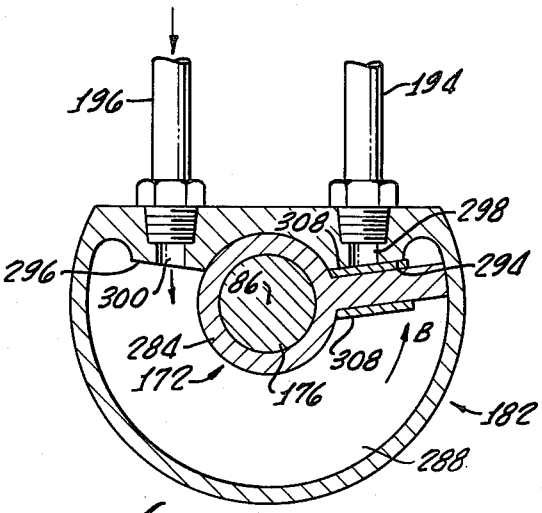
Figure 9A:
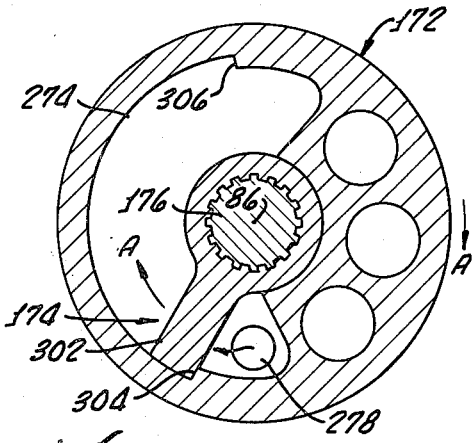
Figure 9B:
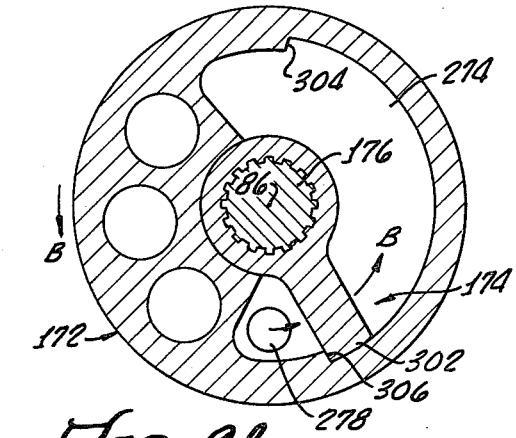
Figure 13:
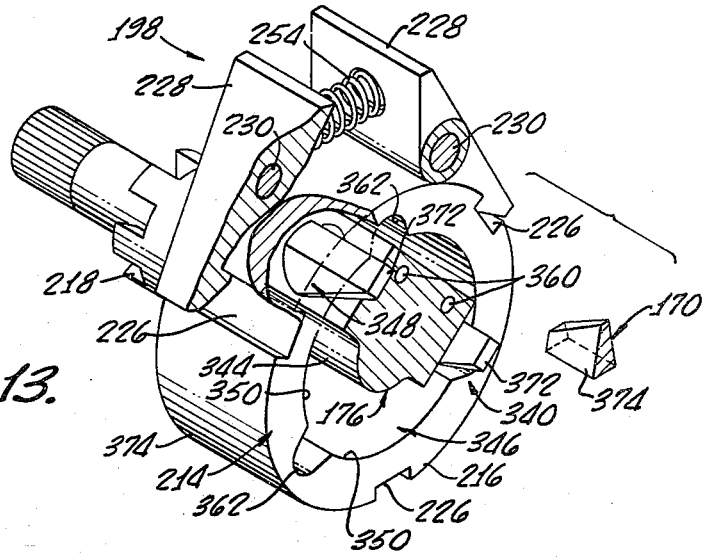
Figure 14B:
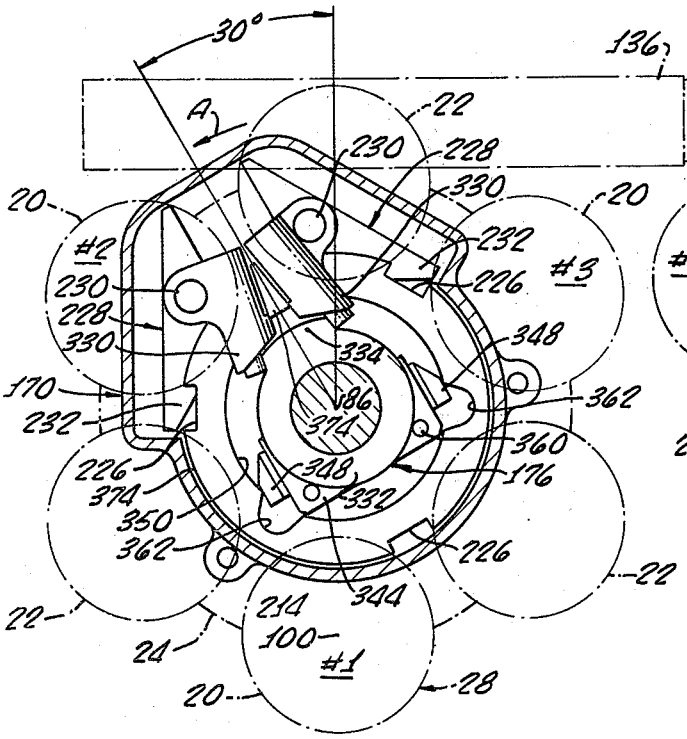
Figure 14A:
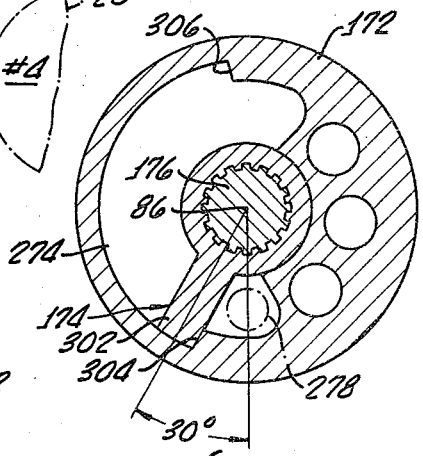
Figure 15B:
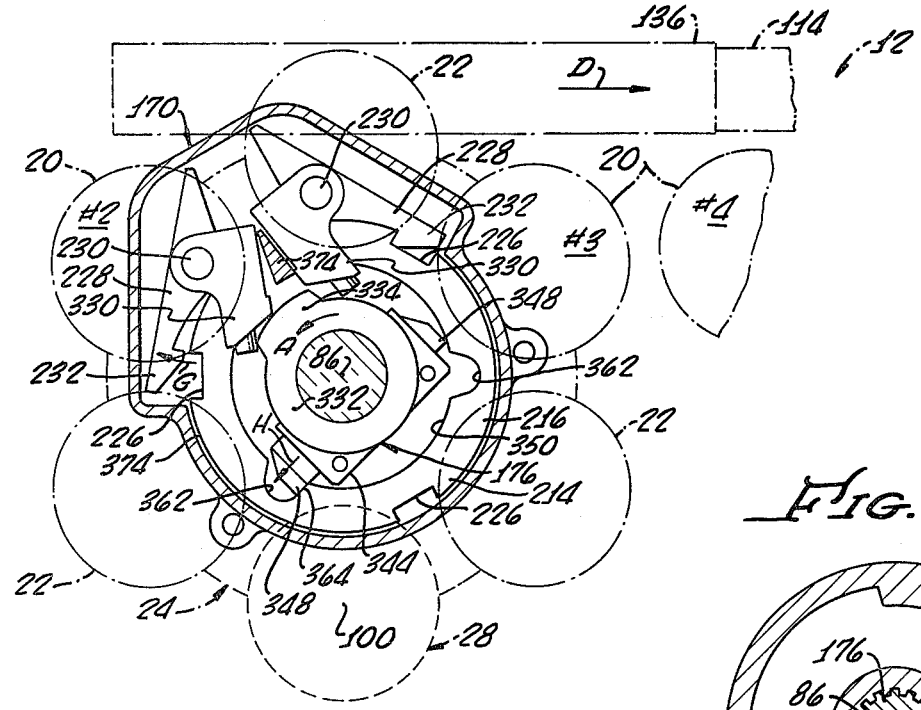
Figure 15A:
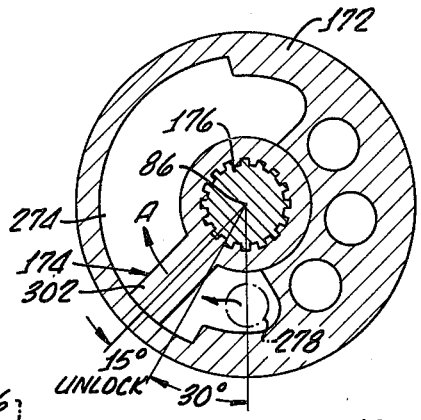
Figure 16B:
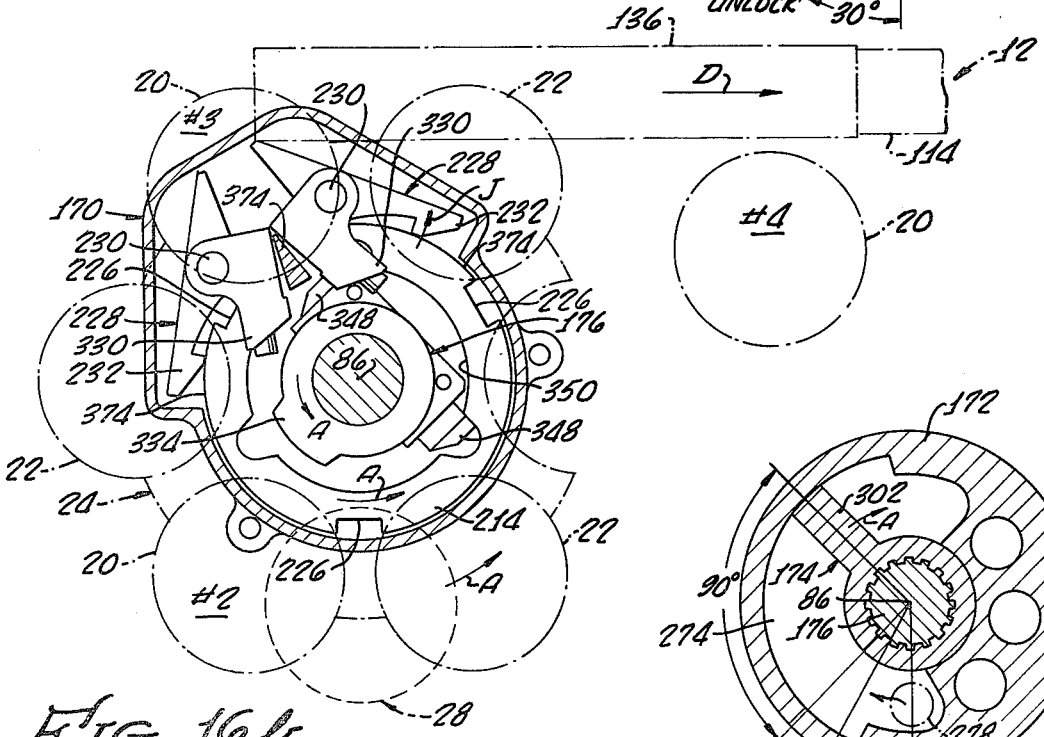
Figure 16A:
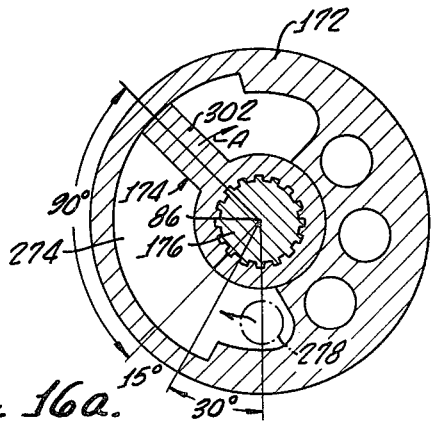

FIG. 7 is a transverse cross sectional view, taken along line 7—7 of FIG. 4, showing a first rotary piston and a central housing of the rotor directional control and rotor drive means, FIG. 7(*a*) showing relative oreintation between the first piston and the central housing for feeding shells from the first shell supply and FIG. 7(*b*) showing alternative relative orientation between the first piston and the central housing for feeding shells from the second shell supply;

FIG. 8 is a transverse cross sectional view, taken along line 8—8 of FIG. 4, showing a second rotary piston and the central housing of the rotor directional control and rotor drive means, FIG. 8(*a*) showing relative orientation between the second piston and the central housing for setting clockwise rotor rotation for feeding shells from the first shell supply, and FIG. 8(*b*) showing alternative relative orientation of the second piston and the central housing for setting counterclockwise rotor rotation for feeding shells from the second shell supply;

FIG. 9 is a transverse cross sectional view, taken along line 9—9 of FIG. 4, showing a pressure chamber portion of the second rotary piston having disposed therein a third rotary piston of the rotor directional control and rotor drive means, FIG. 9(*a*) corresponding to the second piston orientation of FIG. 8(*a*) and showing prefiring relative positioning of the third piston in the pressure chamber for causing clockwise rotor rotation during firing, to feed from the first shell supply and FIG. 9(*b*), corresponding to the second piston orientation of FIG. 8(*b*), and showing prefiring relative position of the third piston for causing counterclockwise rotation during firing to feed from the second shell supply;

FIG. 10 is a schematic drawing of shell supply selector control portions of the dual shell feeding apparatus;

FIG. 11 is a transverse cross sectional view, taken along line 11—11 of FIG. 4, showing features of rotor locking portions of the rotor control and drive means, FIG. 11(*a*) showing a rotor drive member locked against rotation in an orientation for feeding shells from the first shell supply, and FIG. 11(*b*) showing the rotor drive member locked against rotation in an orientation for feeding from the second shell supply;

FIG. 12 is a transverse cross sectional view, taken along line 12—12 of FIG. 4, showing features of rotor drive and ratcheting portions of the rotor control and drive means, FIG. 12(*a*) showing the rotor shaft extension in a prefiring, nondriving relationship with the rotor drive member, in an orientation for feeding shells from the first shell supply, and FIG. 12(*b*) showing the rotor shaft extension in a prefiring, nondriving relationship with the rotor drive member, in an orientation for feeding shells from the second shell supply;

FIG. 13 is a partially cutaway, partially exploded perspective drawing of rotor drive and ratcheting portions of the rotor control and drive means, showing the rotor shaft extension cammed out of driving engagement with the rotor drive member to enable return rotation of the shaft extension after firing;

FIGS. 14(*a*) and 14(*b*) are transverse cross sectional views of the rotor control and drive means, showing prefiring relative orientation of the rotor drive piston, the rotor extension shaft, rotor drive member, rotor and the second stage actuating means when feeding from the first shell supply is selected, FIG. 14(*a*) showing orientation of the rotor drive piston and being similar to, and taken in the same plane and direction of FIG. 9(*a*) and FIG. 14(*b*) being similar to, and taken in the same plane of, but in the opposite (rearward looking) direction of FIG. 12(*a*), to show relative orientation of various operative portions of the feeding apparatus;

FIGS. 15(*a*) and 15(*b*) are transverse cross sectional views, directly corresponding to FIGS. 14(*a*) and 14(*b*), respectively, showing relative orientation of the rotor drive piston, rotor drive member and so forth an instant after firing of the cannon, the rotor drive piston having been rotated to rotate the rotor shaft extension through 15° to unlock the rotor drive member and rotor for shell feeding rotation;

FIGS. 16(*a*) and 16(*b*) are transverse cross sectional views directly corresponding to FIGS. 15(*a*) and 15(*b*), respectively, showing relative orientation of the rotor drive piston, rotor drive member and so forth an instant later in time in which the rotor drive piston has been rotated through 105° thereby rotating the rotor through the first 90° of the 120° shell feeding step.

Figure 19:
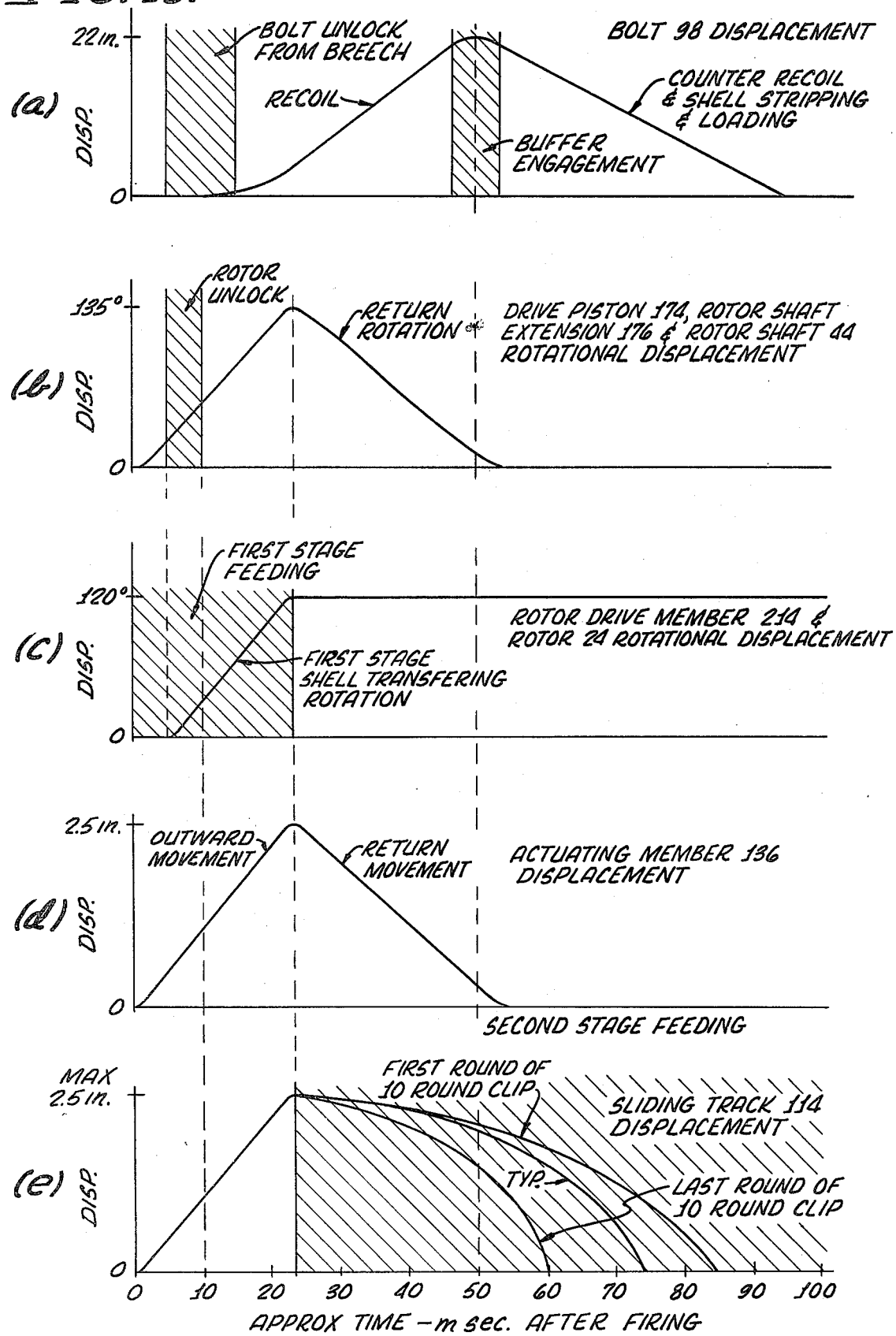

FIGS. 17(*a*) and 17(*b*) are transverse cross sectional views directly corresponding to FIGS. 16(*a*) and 16(*b*), respectively, showing relative orientation of the rotor drive piston, rotor drive member and so forth an instant still later in time in which the rotor drive piston has been fully rotated through 135°, thereby fully rotating the rotor through the 120° shell feeding step to a relocking position;

FIGS. 18(*a*) and 18(*b*) are transverse cross sectional views directly corresponding to FIGS. 17(*a*) and 17(*b*), respectively, showing relative orientation of the rotor drive piston, rotor drive member and so forth an instant still later in time in which the rotor shaft extension has been rotatably disengaged from the rotor drive member and the shaft extension and the rotor drive piston have been partially return rotated towards the orientation of FIGS. 15(*a*) and 15(*b*) in preparation for a next firing; and FIG. 19 is a diagram showing comparative linear or angular displacement, vs. a common time base after firing of an exemplary 35 mm cannon, of the gun bolt (FIG. 19(*a*)), drive piston, rotor shaft extension and rotor shaft (FIG. 19(*b*)), rotor drive member and rotor (FIG. 19(*c*)), the second stage actuation member (FIG. 19(*d*)) and the second stage sliding track (FIG. 19(*e*)).

Figure 1:
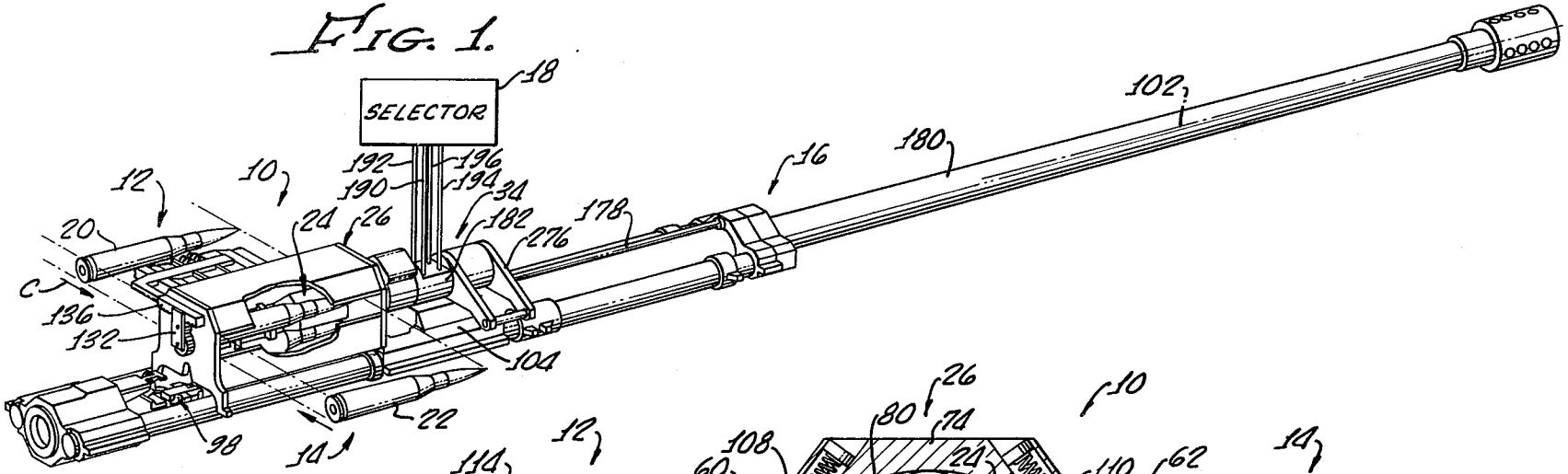
FIG. 1 is a partially cutaway perspective drawing, showing a dual, two stage shell feeding apparatus, according to the present invention, in operative relationship with an exemplary, associated automatic gun or cannon having first and second shell supplies.

In FIG. 1, a dual, two stage shell feeding apparatus 10 is shown mounted for feeding shells from spaced apart, first and second shell supplies or supply means 12 and 14, respectively, to an associated gun 16. Although the dual shell feeding apparatus 10 is readily adaptable, in a manner which will become apparent to those skilled in the related arts, to virtually any type and calibre of gun, the gun 16 is shown, for illustrative purposes with no limitations intended or implied, to be a rapid firing, open framework receiver automatic cannon of the type disclosed in copending U.S. patent application Ser. No. 024,186. The gun 16 may be of 35 mm calibre, being adapted by the dual shell feeding apparatus 10 for both antiaircraft and antitank use. Accordingly, the gun 16 may be part of a more extensive weapons system, not shown.

Also forming part of the dual shell feeding apparatus 10, as more particularly described below, are feed selector control means 18 for enabling rapid selection between firing of first and second types of shells 20 and 22, respectively, from the corresponding first and second shell supplies 12 and 14. Selective use of one type of the shells 20 and 22 against one type of target and the other type of the shells against another type of target is thereby provided. Alternatively, if necessary or desired, both the shell supplies 12 and 14 may be used to contain a single type of shells, thereby providing extended shell capacity, shell feeding operation of the apparatus 10 being completely independent of type of shells being fed thereby.

Figure 2:
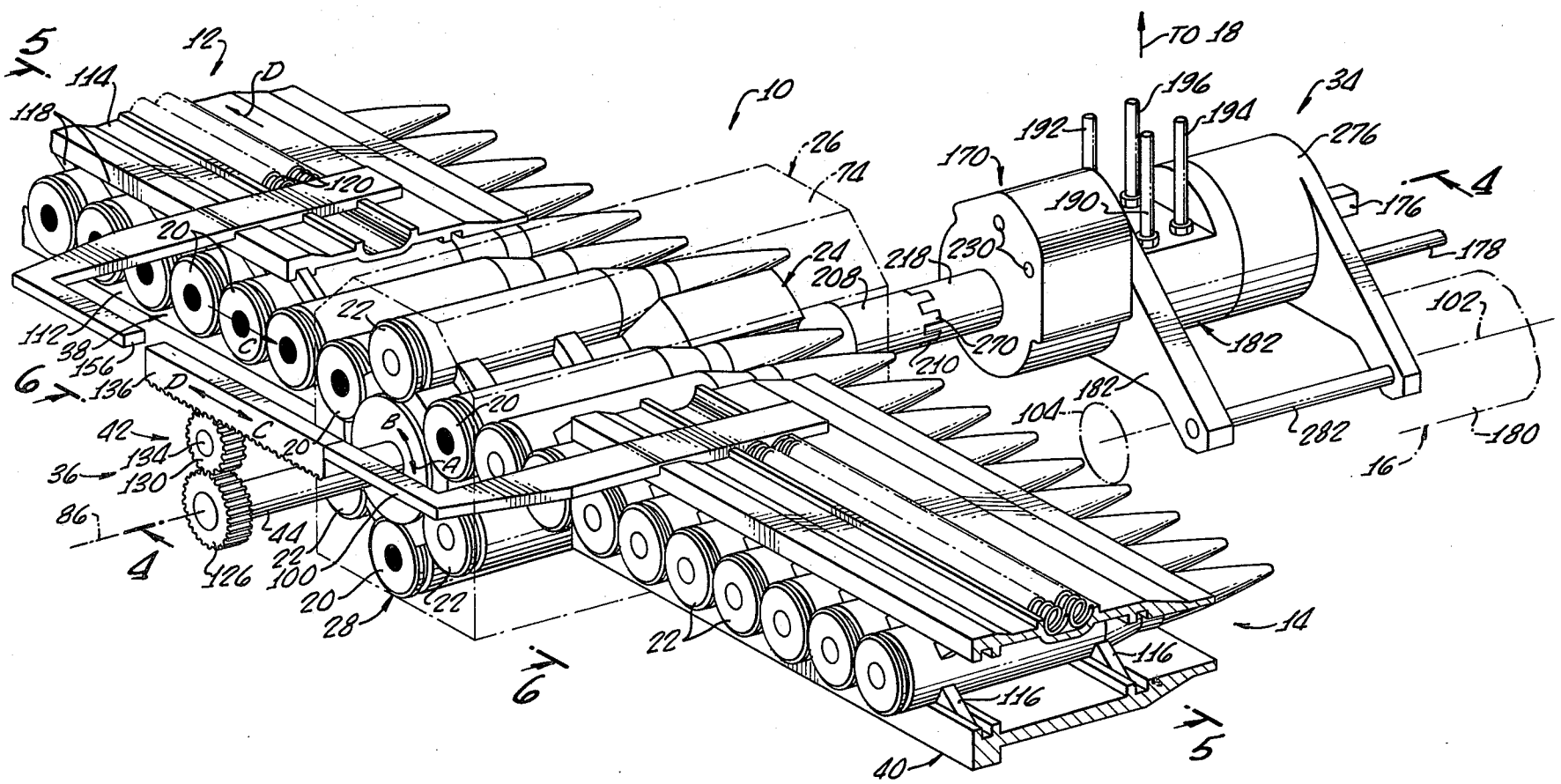
FIG. 2 is a partially cutaway perspective drawing of the dual, two stage shell feeding apparatus of FIG. 1, showing features of a first stage shell rotor having a rotor directional control and rotor drive means forwardly connected thereto and showing features of second stage shell advancing means associated with each of the two shell supplies.

More particualrly shown in FIG. 2, the dual shell feeding apparatus 10 includes a first stage shell transferring rotor or rotor assembly 24 and rotor mounting means 26 for rotatably mounting the rotor, in shell feeding relationship, between the first and second shell supplies 12 and 14 and the gun 16. As described below, the rotor 24 is stepped or indexed in one rotational direction (direction of Arrow "A") to transfer shells 20 from the first shell supply 12 to a shell loading or pick up position 28 and in an opposite rotational direction (direction of Arrow "B") to transfer shells 22 from the second shell supply 14 to the same shell pick up position. Rotor rotational control and drive, also as described below, is provided by a pressure actuated rotational direction control and rotor drive portion or means 34 which is connected, forwardly, to the rotor 24 (FIGS. 1–4) and to the control means 18.

Second stage shell feeding from the shell supplies 12 and 14 into the rotor 24 is provided, as more particularly described below, by second stage feeding means 36. Included in the second stage feeding means 36 are left and right shell advancing or transferring means 38 and 40, respectively, associated with corresponding ones of the shell supplies 12 and 14 (FIG. 2). Actuation of the shell transferring means 38 and 40 is by second stage actuation means 42 operatively interconnected with a rotor mounting shaft 44 about portions of which is installed a return rotation spring 46.

To enable rotational shell transferring from whichever of the shell supplies 12 and 14 is selected into the shell pick up position 28, the rotor 24 comprises a rotor housing 50 (FIGS. 3, 4 and 5) having means defining a plurality of longitudinal, peripheral shell holding cavities. As illustrated and for reasons which will become apparent from the ensuing description, a first rotor cavity set 52, having a plurality (three being shown) of first rotor cavities 54, and a second rotor cavity set 56, having a plurality (three being shown) of second rotor cavities 58, are provided, the first and second cavities being arranged in an alternating relationship around the rotor housing 50. In operation, rotational transfer of the shells 20 from the first shell supply 12 into the pick up position 28 is by the first cavity set 52, rotational transfer of the shells 22 from the second shell supply 14 into the pick up position being by the second cavity set 56.

Figure 5A:
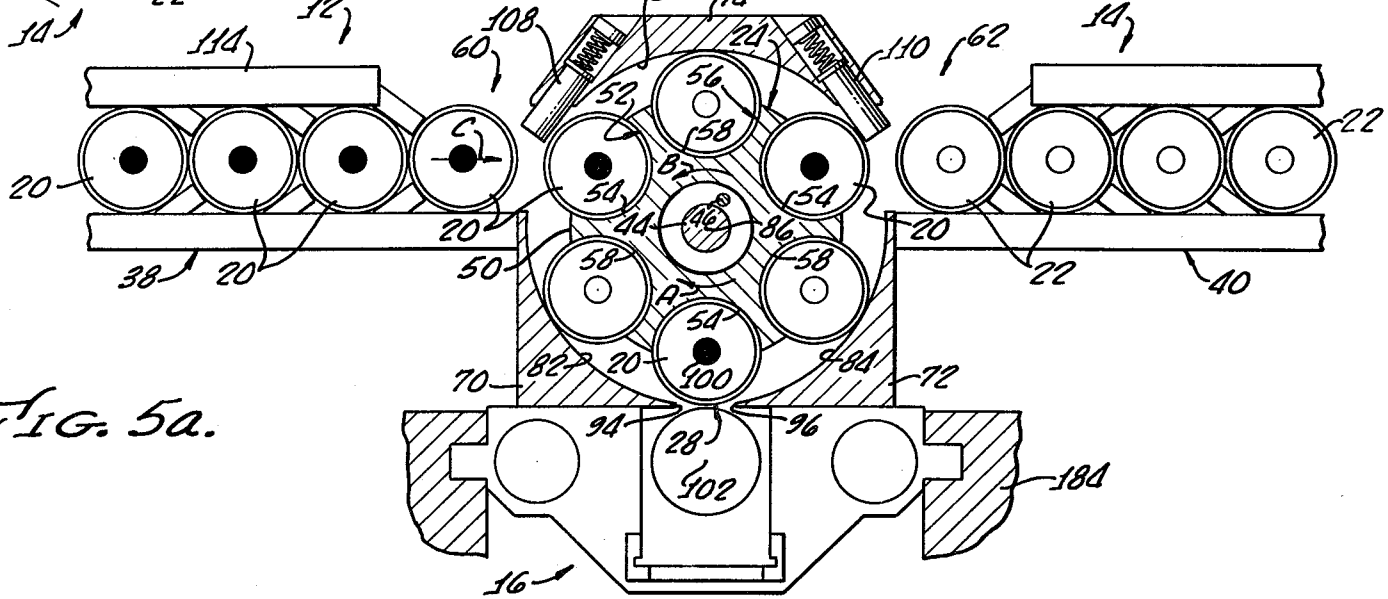
FIG. 5 is a transverse cross sectional view, taken along line 5—5 of FIG. 2, FIG. 5(*a*) showing rotor prefiring orientation for feeding the cannon from the first shell supply and FIG. 5(*b*) showing rotor prefiring orientation for feeding the cannon from the second shell supply.
Figure 5B:
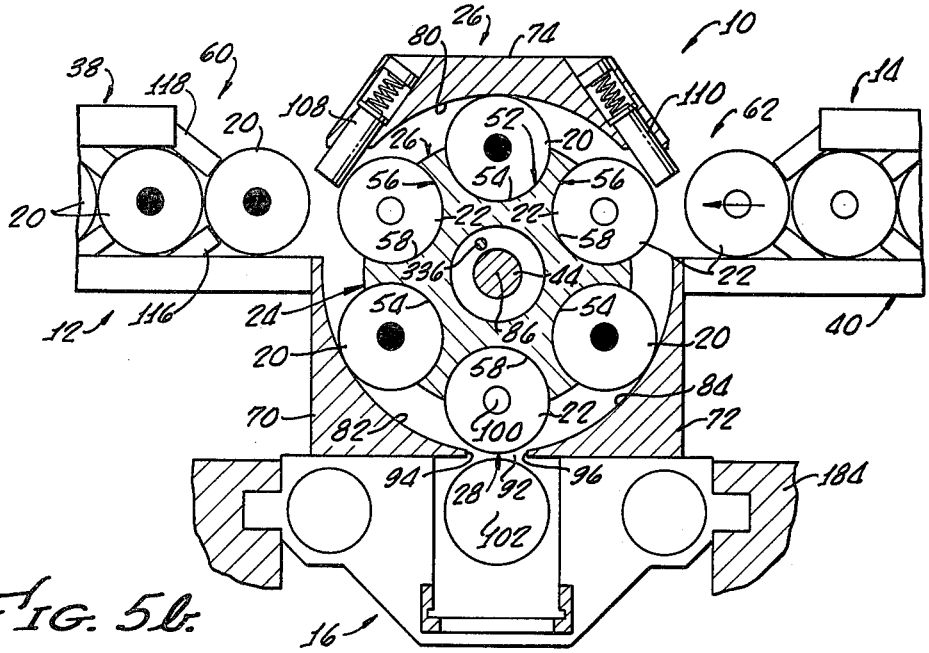

Size, particularly diameter, of the rotor housing 50, as well as relative positioning between the rotor 24, the first and second shell supplies 12 and 14 and the gun shell pick up position 28 is selected to cause, whenever one of the first cavities 54 is indexed into the pick up position, another one of such cavities to be in shell receiving relationship, or aligned, with a shell outfeed region 60 of the first shell supply 12 (FIG. 5(*a*)). In a like manner, whenever one of the second cavities 58 is indexed into the shell pick up position 28 (FIG. 5(*b*)), another one of such cavities is caused to be in shell receiving relationship, or aligned, with a shell outfeed region 62 of the second shell supply 14.

Because of use in the illustrative configuration of three first rotor cavities 54 and three second rotor cavities 58, the cavities being consequently spaced at 60° intervals around the rotor housing 50, the first and second shell supply outfeed portions 60 and 62 are located at angles of approximately 120° to opposite sides of the shell pick up position 28.

Rapid shifting between feeding the gun 16 from the first and second shell supplies 12 and 14 is enabled by maintaining the rotor 24 fully loaded whenever firing is stopped. And, as described below, by rotating the rotor 24 clockwise, as seen in FIG. 5(*a*) (direction of Arrow "A") for feeding the gun 16 from the first shell supply 12 and counterclockwise, as seen in FIG. 5(*b*) (direction of Arrow "B") for feeding from the second shell supply 14.

Forming sides and bottom of the rotor mounting means 26 are rigid, laterally spaced apart first and second feed lip members 70 and 72, respectively, (FIG. 5). An upper transverse member 74 (FIGS. 4 and 5) forms the top of the rotor mounting means 26. Opposite ends of the members 70, 72 and 74 are fixed, as by bolting, to forward and rearward transverse rotor mounting end plates 76 and 78, respectively.

Containment of the shells 20 and 22 in the rotor cavities 54 and 58 during shell transferring rotor rotation, is provided by adjacent arcuate inner surface regions 80 of the upper member 74 and by adjacent arcuate inner surface regions 82 and 84, respectively, of the feed lip members 70 and 72. Radius of the surface regions 80, 82 and 84 is slightly greater than a radius "R" (FIG. 5(*a*)) from a longitudinal rotor axis 86 to extreme outer surface regions of the shells 20 and 22 held in the rotor cavities 54 and 58, such surface regions being positioned closely adjacent to the shell outer surface regions.

A bolt clearance gap 92 between adjacent opposing side edges 94 and 96, respectively, of the feed lip members 70 and 72 (FIG. 5) adjacent the shell pick up position 28, provides clearance for pick up portions of a bolt assembly 98 (FIG. 1) during shell stripping. Since a longitudinal axis 100 of shells in the pick up position 28 is offset above a barrel bore axis 102, width of the gap 92 necessarily increases in a forward direction to enable shells forwardly stripped by the bolt to move inwardly, between forward regions of the feed lip members 70 and 72, towards the barrel bore axis and to move forwardly towards a gun breech 104 (FIGS. 1, 2 and 4). Feed path control may be provided for the shells from the pick up position 28 to the breech 104 by rotor cavity and feed lip member configuration in a manner described in the above-mentioned copending patent application, Ser. No. 06/089,308.

First and second, spring loaded detent pin assemblies 108 and 110, respectively, mounted at opposite side edge regions of the upper, transverse member 74, inwardly adjacent to the shell supply outfeed regions 60 and 62 (FIG. 5), prevent unintended shell movement between the shell supplies 12 and 14 and the rotor 24. The pin assemblies 108 and 110 also importantly prevent movement of shells outwardly from the rotor 24 back into the shell supplies 12 and 14 during rotor rotation.

Shells advancing from the shell supplies 12 and 14, past the detent pin assemblies 108 and 110, into the respective rotor cavities 54 and 58 is enabled by the left and right, second stage shell transferring means 38 and 40 and the second stage actuating means 42, second stage shell transferring being thereby also responsive to rotor rotation 24.

As seen in FIG. 2, the left shell transferring means 38 comprises a fixed lower track 112 and a slidable upper track 114 between which the shells 20 are fed from the first shell supply 12 towards the outfeed portion 60 and the rotor 24. The fixed track 112 may, as illustrated, be generally U or V-shaped, in longitudinal cross section parallel to the bore axis 102, to wrap partially around the shells 20, thereby not only providing underneath shell support but also slidably mounting the slidable track 114 in a manner enabling such track to slide a limited distance inwardly and outwardly relative to the rotor 24 for shell transferring purposes. The fixed track 112 may be independent from the shell supply 12 or be formed as part thereof. Thus, for example, if the shell supply 12 is in drum form, the fixed track 112 may comprise a wall portion of the drum segment, each segment being constructed with an associated pair of tracks 112 and 114. Alternatively, for example, when the shell supplies 12 and 14 are in belt form, the track 112 may be formed as a fixed or detachable, sidewardly projecting portion of the rotor mounting means 26.

Several pairs of spring loaded bottom pawls 116, pivotally mounted to the fixed track 112, project generally upwardly and inwardly, at about 45°, towards the rotor 24 at shell spacing intervals. By downwardly deflecting against their springs, the bottom pawls 116 enable the shells 20 to be moved inwardly towards the rotor 24 in a shell loading direction (direction of Arrow "C", FIG. 2). However, when in their normal, raised position, the bottom pawls 116 prevent backing up of the shells 20 away from the rotor 24.

Spring loaded upper pawls 118 are correspondingly mounted to the upper, slidable track 114 to project downwardly and inwardly at about 45°. By upwardly deflecting against their springs, the upper pawls 118 enable the track 114 to be pushed outwardly over the shells 20 away from the rotor 24 (direction of Arrow "D", FIG. 2) by the actuation means 42, as described below. However, as the track 114 then returns inwardly back towards the rotor 24 (direction of Arrow "C"), the upper pawls 118 push the shells 20 engaged thereby in the loading direction to cause the endmost shell to be advanced into an adjacent one of the rotor cavities 54. This return movement of the slidable track 114 is caused by springs 120 mounted in driving relationship therewith.

Inasmuch as the right hand shell transferring means 40 associated with the second shell supply 14, is preferably a mirror image of the above described left hand shell transferring means 38 associated with the first shell supply 12, the right hand shell transferring means is not separately described, both the shell transferring means operating in an equal and opposite manner but independently of one another.

As mentioned above, the fixed track 112 may comprise wall segments of a rotating drum-type magazine, each segment being configured to hold a number of the shells 20 and having its own fixed track which is rotated into feeding alignment with the rotor 24 as that segment is selected for firing. Alternatively, the shells 20 (or 22) may be belt fed into the transferring means 38 (or 40), the associated fixed track 112 then incorporating generally conventional, means (not shown) for stripping the end shell or shells from the belt. However, used with any type of shell supply, once the shells 20 and 22 are introduced into the shell transferring means 38 and 40, subsequent shell loading into the rotor 24 is caused by the upper track 114 sliding inwardly relative to the fixed lower track 112, independently of the shell supply configuration.

Shell advancing movement of the sliding track 114 is coordinated to rotation of the rotor 24 by the second stage actuating means 42 (FIGS. 1, 2, 4 and 6) which is operated in unison with rotation of the rotor shaft 44. Included in the second stage actuation means 42 is a conventional drive gear 126 directly fixed to a rearward end of the rotor shaft 44. The drive gear 126 is mounted on the shaft 44 rearwardly of the rear end plate 78 and between such end plate and a corresponding rear support bracket 132. A conventional idler gear 130 is correspondingly mounted on a pivot pin 134 between the rear end plate 78 and the support bracket 132 above, and in driven meshed engagement with, the drive gear 126.

Transversely, slidably mounted through sides of the support bracket 132, above the idler gear 130 and in driven meshed relationship therewith, is a rackgear actuation member 136. As seen in FIG. 4, first and second transverse projections or tracks 140 and 142, formed along opposite front and rear sides of the actuation member 136, are slidably received into corresponding transverse mounting grooves or recesses 144 and 146 formed, respectively, in the rear end plate 78 and the bracket 132.

Figure 6A:
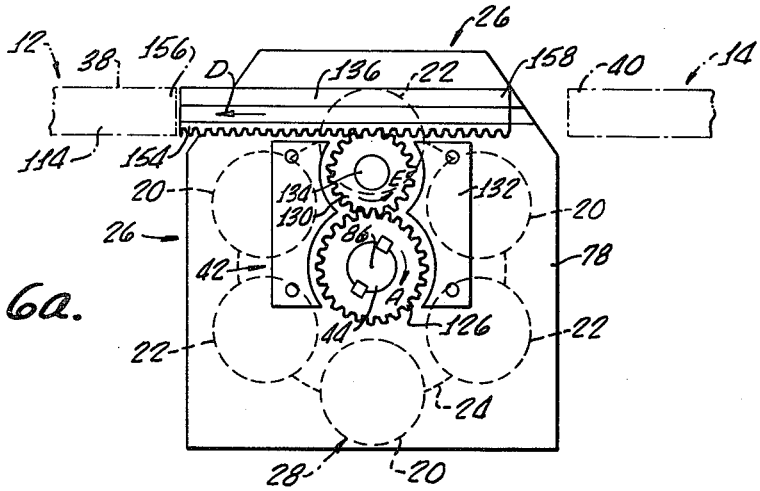
FIG. 6 is a transverse, rear end view, taken along line 6—6 of FIG. 2, showing second stage actuation means coupled to the first stage shell feeding rotor, FIG. 6(*a*) showing actuation for feeding from the first shell supply and FIG. 6(*b*) showing actuation for alternatively feeding from the second shell supply.
Figure 6B:
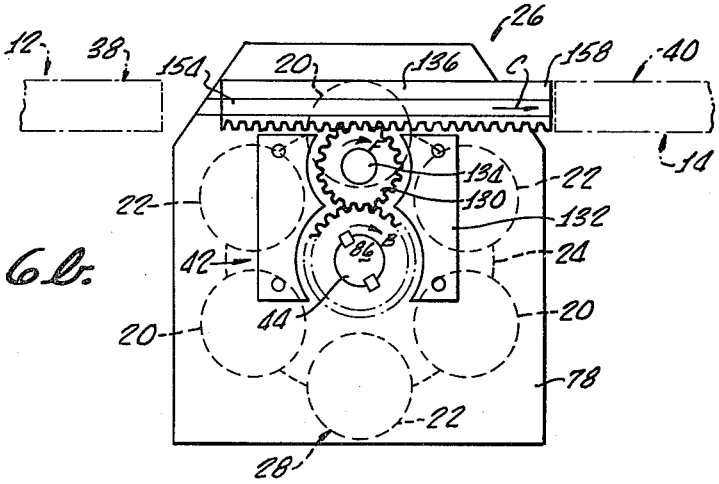

Consequently, as the rotor shaft 44, and with it the drive gear 126, is rotated clockwise, as shown by arrow "A" in FIG. 6(*a*) for feeding from the first shell supply 12, the idler gear 130 is driven counterclockwise in the direction of Arrow "E". In turn, the idler gear 130 drives the actuation member 136 outwardly towards the first shell supply 12, in the direction of Arrow "D". The actuation member 136 is constructed relative to the slidable track 114 so that a first end portion 154 of the member is in pushing engagement with an inner end portion 156 of the slidable track. Thus, outward movement of the actuation member 136 simultaneously pushes the track 114 outwardly, thereby compressing the associated drive springs 120. Upon immediate return rotation of the rotor shaft 44, as described below, with consequent simultaneous return of the actuation member 136 to its initial position, the drive springs 120 push the sliding track 114, and with it the shells 20 engaged by the upper pawls 118, in the shell advancing direction of Arrow "C", FIG. 2, to transfer an end one of the shells 20 into one of the aligned rotor cavities 54.

In a similar manner, as depicted in FIG. 6(*b*), as the rotor shaft 128 is rotated counterclockwise, in the direction of Arrow "B", to feed the gun 16 from the second shell supply 14, the idler gear 130 is rotated clockwise (direction of Arrow "F"), thereby moving the actuation member 136 outwardly (direction of Arrow "C") towards the second shell supply. Such outward movement of the member 136 pushes outwardly the sliding track associated with the second shell supply 14, compressing the corresponding drive springs. When the actuation member 136 is then returned to its initial position, by return rotation of the rotor shaft 44, the sliding track springs drive the sliding track and the shells 22 engaged thereby towards the rotor 24 to transfer an end shell into an aligned one of the rotor cavities 58.

From the foregoing description, when the first shell supply 12 is selected, it is apparent that the rotor cavity set 52 transfers, in 120° incremental clockwise rotor steps (direction of Arrow "A"), the shells 20 from the first shell supply into the pick up position 28 for picking up, loading and firing by the forwardly traveling bolt assembly 98. In a like manner, when the second shell supply 14 is selected, the second cavity set 56 transfers, in 120° incremental counterclockwise rotor steps (direction of Arrow "B"), the shells 22 from the second shell supply into the pick up position 28, for picking up, loading and firing by the bolt assembly.

In feeding from either of the shell supplies 12 and 14, as further described below, during first stage shell feeding, responsive to each firing of the gun 16, a next shell in the rotor 24 is rapidly rotated into the shell pick up position 28. During subsequent second stage shell feeding, responsive to first stage shell feeding, an end shell from the selected one of the shell supplies 12 or 14 is advanced into an adjacent one of the empty rotor cavities 54 or 58.

Selection between shell feeding of the gun 16 from the first or second shell supplies 12 and 14 is thus, in effect, done by selecting which of the two rotor cavity sets 52 and 56 are to be used for rotary shell transferring. Such cavity set selection, when shifting from one of the shell supplies 12 and 14 to the other, is, in turn, accomplished by indexing the rotor 24 one cavity spacing, that is, 60°, in the appropriate direction prior to firing. This 60° rotor indexing indexes one of the cavities corresponding to the selected shell supply into the shell pick up position 28, with another one of the same set of cavities being indexed simultaneously into shell transferring relationship with the selected shell supply. After this prefiring 60° rotor indexing, with each shell subsequently fired, the rotor 24 is indexed in 120° increments, in the appropriate direction, according to shell supply selected, to cause indexing of successive shells held in the selected cavity set into the shell pick up position 28.

To enable rapid shifting between feeding from either of the two shell supplies 12 and 14, the rotor 24 is kept fully loaded with three of the shells 20 in the cavities 54 and three of the shells 22 in the cavities 58. Prefiring rotor charging of the six shells may, for example, be by appropriate repetitive operation of the actuation member 136 by charging means (not shown), with appropriate 60° rotor indexing between loading the two types of shells. Subsequently, the rotor 24 is kept fully loaded at the end of each firing by following the bolt searing up operation described in my copending U.S. patent application, Ser. No. 06/089,308. Thus, when the rotor 24 is fully loaded with six shells, any prefiring, 60° indexing of the rotor 24, in either direction, to change feeding of the gun 16 from one of the shell supplies 12 and 14 to the other will always result in indexing a shell into the shell pick up position 28, regardless of rotor position, no preferential rotor indexing or additional charging being therefore necessary.

Thus, it is apparent that two stage shell feeding by the apparatus 10, from either of the two shell supplies 12 and 14, depends, first, on prefiring, 60° indexing of the rotor 24 to select from which of the two shell supplies the gun 16 is to be fed and, second, during firing, on repetitive, 120° incremental indexing of the rotor 24 in the appropriate direction to transfer shells from the selected shell supply into the shell pick up position 28.

Both of these important functions are provided by the rotor rotational direction control and rotor drive means 34, in which pressurized fluid from the selector control means 18 is used to cause prefiring 60° rotor indexing and to establish or "set" a corresponding feeding rotational direction of the rotor 24. Pressurized barrel gas is then used in the control and drive means 34 to cause subsequent 120° incremental rotor rotation, and consequent operation of the second stage actuation means 42, during firing of the gun 16.

In addition, because of problems associated with constructing a rotor drive means in which the rotor shaft 44 is, during firing, also incrementally rotated in a continuous stepwise manner with the rotor 24, the control and drive means 34 is additionally configured for enabling continuous, 120° stepwise incrementing of the rotor 24, during firing, by rotational reciprocating movement of the rotor shaft. Accordingly, the control and drive means 34 also importantly provides, as described below, for bidirectional ratcheting interconnection between the rotor 24 and the rotor shaft 44.

Figure 3:
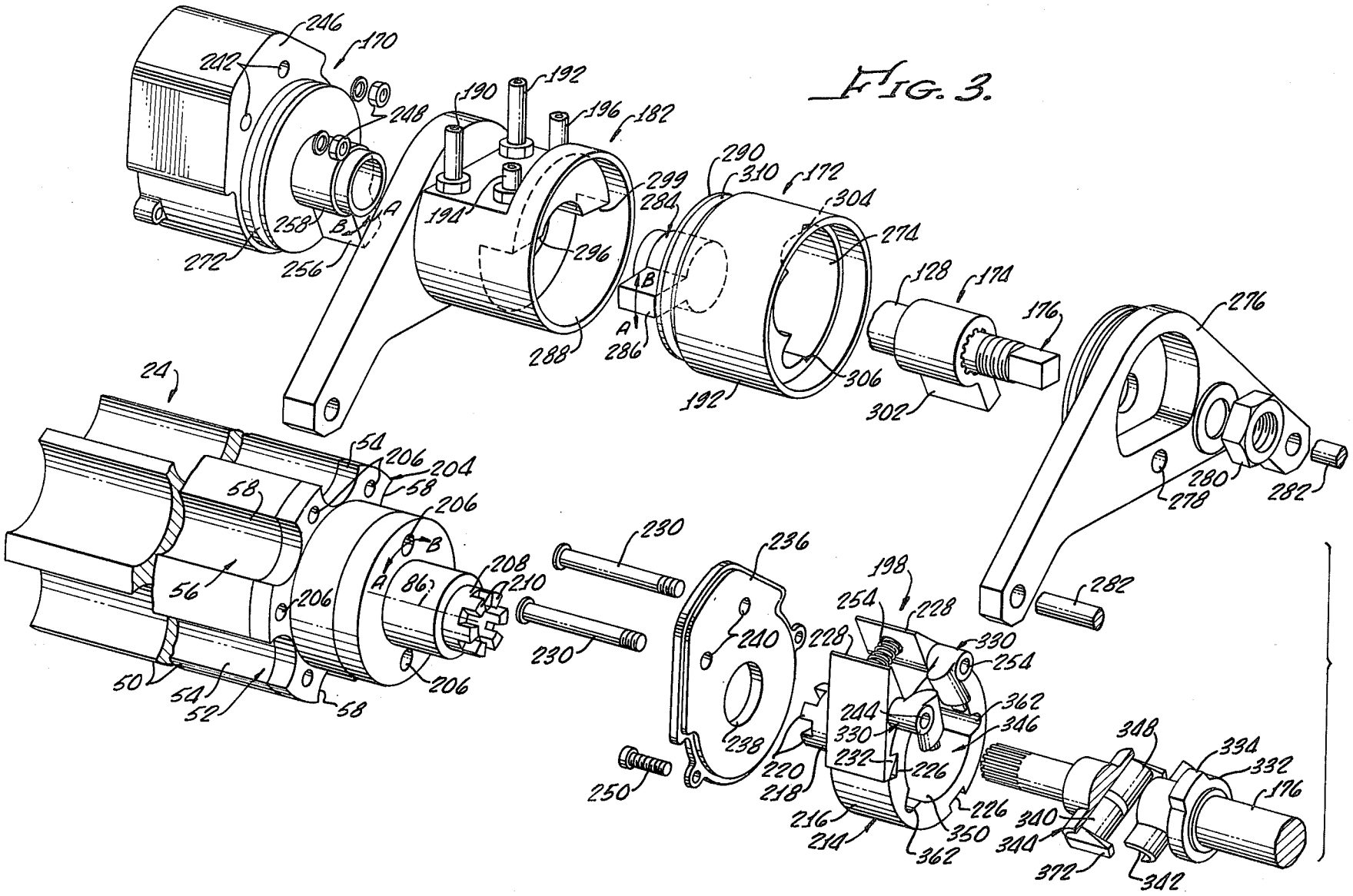
FIG. 3 is a partially cutaway, exploded perspective drawing showing the first stage shell rotor and the rotor directional control and rotor drive means forwardly connected thereto.

As shown in FIGS. 3 and 4, the rotor control and drive means 34 comprises generally a first, bidirectional rotor indexing rotary piston or valve 170 for prefiring rotor indexing; a second, bidirectional rotary piston or valve 172 for establishing or setting rotor rotational direction during gun firing and a third, bidirectional rotor drive rotary piston or valve 174 for causing rotor indexing during firing. Configured for simultaneous operation by pressurized fluid from the selector control means 18 (FIGS. 1 and 2), before firing or between bursts, the first and second pistons 170 and 172 are rotatably mounted around a rotor shaft extension 176, which is splined at a rearward end to a forward end of the rotor shaft 44.

In contrast, the third, rotor drive piston 174 is nonrotatably fixed, for example, by a splined interconnection, to a forward end region of the rotor shaft extension 176. Thus when the drive piston 174 is rotatably actuated during firing, by pressurized barrel gas fed through gas supply means 178 from a barrel 180 of the gun 16 (FIGS. 1 and 2), the shaft extension, and hence also the shaft 44 and rotor 24, is simultaneously rotated to cause shell transferring into the pick up position 28.

Also forming part of the rotor rotational control and drive means 34 is a hollow, generally semicylindrical central housing 182, configured for receiving actuable vane portions of the first and second rotary pistons 170 and 172. The central housing 182 is nonrotatably fixed, for example, to a cradle support 184 (FIG. 3) into which the gun 16 is axially slidably mounted. Pressurized fluid, preferably hydraulic fluid, for rotatably operating the first and second pistons 170 and 172 is fed to the central housing 182 through first, second, third and fourth pressure lines 190, 192, 194 and 196, respectively, from the selector control 18.

Included also in the control and drive means 34 are rotor locking and ratcheting means 198 which interconnect the rotor 24, the shaft extension 176 and the first piston 170. Such means 198, as hereinafter described, enables bidirectional reciprocating rotational movement of the shaft extension, by the drive piston 174, while transmitting unidirectional rotational indexing to the rotor 24 during firing.

Considering first the enablement for prefiring rotor indexing to select between feeding from the two supplies 12 and 14, the rotor 24 includes a forward rotor hub 204 which is fixed to a forward end of the rotor housing 50 by a plurality of bolts 206. Formed around a forward end of a forwardly projecting, reduced outer diameter, hollow cylindrical hub portion 208 is a plurality of equally spaced apart, rectangular peripheral teeth 210 (FIG. 3). As seen in FIG. 4, the rotor hub portion 208 extends, upon assembly, forwardly through a bearing aperture 212 in the forward, rotor mounting end plate 76, thereby providing forward rotational support or journaling of the rotor 24.

Rotatably disposed around the shaft extension 176, and forming part of the rotor locking and ratcheting means 198, is a rotor drive member 214 having a larger outer diameter, hollow cylindrical forward portion 216 and a smaller outer diameter, hollow cylindrical rearward portion 218. Equally spaced around a rearward end of the drive member rearward portion 218 is a plurality of peripheral rectangular teeth 220 which mate, on assembly, with the rotor hub teeth 210 to rotatably lock the rotor drive member 214 to the rotor hub 204 for imparting rotary movement of the drive member to the rotor 24.

Three rectangular grooves 226 are formed radially inwardly into the periphery of the rotor drive forward portion 216. These grooves 226, formed parallel to the rotor axis 86, are equally spaced apart at 120° intervals and extend the length of the forward portion 216. Locking of the rotor drive member 214 against rotation, and in consequence locking the rotor 24 at indexed shell feeding positions to assure reliable shell feeding, is enabled by an opposed pair of spring loaded locking pawls 228, which are pivotally mounted, by pins 230, to interior regions of the first rotary piston 170.

Each of the locking pawls 228 has, at a lower end, an inwardly projecting, beveled hook 232 configured for engaging individual ones of the rotor drive member grooves 226 in a manner preventing rotation of the rotor drive member 214 (and hence the rotor 24) in one direction, while permitting, by ramping action of the pawl hook out of the engaged rotor drive groove, free rotation of the rotor drive member in the opposite direction. When both of the locking pawl hooks 232, which are oriented in back-to-back relationship, are received or engaged in separate ones of the three rotor drive member grooves 226, the rotor drive member 214, and consequently the rotor 24, is locked against rotation in either direction. However, when either one of the pawl hooks 232 is individually released from its drive member groove 226, according to shell supply selected, in a manner described below, single directional rotation of the drive member 214, and of the rotor 24 and shells contained therein, is enabled for shell feeding during firing of the gun 16.

Upon assembly, the rotor drive portion 216 and the two locking pawls 228 are forwardly received into a large, rearwardly opening recess 234 defined in the first rotary piston 170. Closing the recess 234, after assembly, is a rear end plate 236, through an axial aperture 238 of which the drive member rearward portion 218 extends rearwardly. The pins 230 mounting the locking pawls 228 extend, parallel to, but offset above and to opposite sides of the rotor axis 86, through apertures 240, 242 and 244 formed, respectively, through the end plate 236, upper regions of the pawls 228 and a forward wall 246 of the piston 170. Nuts 248 threaded onto forward ends of the pins 230 retain the pins in place. Lower regions of the end plate 236 are fixed to the first piston 170 by bolts 250.

Associated with the locking pawls 228 are compression spring 254 (FIG. 3) installed between upper end regions of the pawls, above pawl pivot axes defined by the pawl mounting pins 230. The springs 254 urge the pawl hooks 232 inwardly towards, and into locking engagement with, the rotor drive member grooves 226 when the pawl hooks and the grooves are aligned.

It follows that since the locking pawls 228 are mounted within the first rotary piston 170, when both the pawl hooks 232 are engaged with corresponding ones of the rotor drive member grooves 226, the rotor 24, through the rotor drive member 214, and the rotor hub 204, is constrained to rotate in unison with the first piston. Consequently, rotating the first rotary piston 170 back and forth through 60°, simultaneously rotates the rotor 24 through 60° to index one of either the first or second rotor cavities 54 or 58 into the shell pick up position 28. Such rotational movement of the first rotary piston 170 is thus operative for selecting the set of rotor cavities 52 and 56 for feeding the gun 16, and hence for selecting from which of the shell supplies 12 and 14 the gun is to be fed.

Prefiring rotation of the first rotary piston 170, to select the shell supply for feeding the gun 16, is enabled by a thin, rectangular piston vane 256 which radially projects from lower regions of a small outer diameter, hollow cylindrical forward portion 258. When assembled (FIG. 4), this piston portion 258, with depending vane 256, is received into a generally keyhole-shaped, rearwardly opening recess 260 formed in the central housing 182. Side surfaces or walls 262 and 264 (FIGS. 2 and 7) of the housing recess 260 are spaced apart an angular distance limiting rotational movement of the first piston 170 to 60° by abutment with the piston vane 256.

Assuming all the rotor cavities 54 and 58 are loaded with shells before firing and that the system is configured so the rotor 24 is still fully loaded whenever firing is interrupted, rotational direction of the first piston 170 and the rotor is immaterial to select between the shell supplies 12 and 14. However, for illustrative purposes, relative configuration and assembly of the central housing 182 and recess 260, the piston vane 256, the first rotary piston 170, the rotor drive member 214 and grooves 226 therein, the locking pawls 228 and the mating teeth 220 and 210 on the first rotary piston portion 218 and on the rotor hub portion 208 cause one of the first rotor cavities 54 to be indexed into the shell pick up position 28 (FIG. 5(*a*)) when the valve is rotated fully clockwise (direction of Arrow "A", FIG. 7(*a*)), the first shell supply 12 being thereby selected for feeding the gun 16. When the first piston 170 is then rotated from such position through 60° in the counterclockwise direction (Arrow "B", FIG. 7(*b*)) until the piston vane 256 abuts the opposite recess side wall 262, one of the second rotor cavities 58 is indexed into the shell pick up position 28 (FIG. 5(*b*)), the second shell supply 14 being thereby selected for shell feeding.

To cause 60° bidirectional first piston rotation to select between the shell supplies 12 and 14 in the described manner, first and second fluid apertures or conducts 266 and 268, respectively, are formed downwardly through opposite upper regions of the housing 182 into communication with the recess 260 (FIG. 7). An upper inlet end of the first aperture 266 has connected thereto the pressure line 190 from the selector control 18. The lower end of the aperture 266 communicates with the recess 260 through the recess side surface 262. Correspondingly, the second aperture 268, to an upper, housing inlet end of which the pressure line 192 is connected, communicates with the recess 260 through the opposite housing recess side surface 264.

Conventional pressure sealing of the first piston 170 relative to the housing 182 and sealing of the piston vane 256 relative to the housing recess 260, including seals 270 on sides of the vane and "O" ring seals 272 between the housing and the piston is assumed. Thus, fluid pressure applied through the first line 190 and the aperture 266 and acting on one side of the vane 256 rotates the first piston 170 to, and maintains it at, its maximum clockwise rotational position (FIG. 7(*a*)). In this piston position, feeding from the first shell supply 12 is selected, with the rotor 24 being oriented with one of the first rotor cavities 54 in the shell pick up position 28 and another one of these cavities in shell transferring relationship with the first shell supply.

When pressure from the selector control means 18 is then applied through the side surface 264 of the housing recess 260, through the second pressure line 192 and the aperture 268, pressure acting on the piston vane 256 rotates the first piston 170 60° counterclockwise (Arrow "B", FIG. 7(*b*)). This rotates the rotor 24 60° to enable feeding of the shells 22 from the second shell supply 14.

After the above described 60° prefiring indexing of the rotor 24, by operation of the first piston 170, to select between feeding shells from the first and second shell supplies 12 and 14, subsequent 120° rotational indexing of the rotor 24, after each shell is fired, is needed to keep advancing shells from the selected supply to the pick up position 28 for pick up by the bolt assembly 98.

However, to enable the rotor 24 to remain fully loaded at the end of any firing cycle, the rotor is indexed clockwise (Arrow "A", FIG. 5(*a*)) when feeding the shells 20 from the first supply 12 and counterclockwise (Arrow "B", FIG. 5(*b*)) when feeding the shells 22 from the second supply 14. As a result, each of the shells transferred from either shell supply into the rotor 24 is subsequently rotated through 240°, in two 120° indexing steps, before reaching the pick up position 28. Therefore, assuming that after stopping firing, the rotor 24 is indexed another 120° to rotate the rotor cavity from which the last shell fired was just stripped to the shell supply, and that a shell is then transferred from the supply into such cavity, firing is stopped with the rotor 24 completely loaded, as is desirable for the reasons hereinabove set forth.

This different directional rotation of the rotor 24, according to the shell supply selected for feeding, provides the requisite transverse, bidirectional pushing action of the second stage actuation member 136.

As shown and described herein, rotational indexing direction of the rotor 24 for shell feeding is established or "set" simultaneously with selection of the shell supply. This latter is accomplished, together with prefiring rotor indexing for selecting shell feeding, as shown in FIGS. 3, 4 and 8, by rotation of the second rotary piston 172. Such piston 172 has formed therein a forwardly opening pressure chamber 274 into which the third, rotor drive piston 174 is received. This pressure chamber 274 is closed, on assembly, by a fixed, nonrotating forward end cap 276 having a pressurized barrel gas pressure line 178 (FIGS. 1 and 2). A large nut 280 retains the cap 276 on the shaft extension 176 and bolts 282 interconnect the cap and the central housing 182.

Rotation of the second piston 172 rotates the pressure chamber 274 relative to the third piston 174 (FIG. 9), in a manner routing gas pressure from the inlet 278 to either one side or the other of the third piston according to the required rotor rotational direction associated with the selected shell supply for feeding.

Constructed generally similarly to the first piston 170, the second rotary piston 172 has a reduced diameter, hollow cylindrical, rearward portion 284 with a thin rectangular vane 286 projecting radially therefrom. To assemble, the piston portion 282, including the vane 286, is installed into a generally hemicylindrical recess 288 formed rearwardly into the central housing 182 from a forward end thereof. Forwardly closing the recess 288 is a transverse wall 290 of a larger diameter, forward portion 292 of the second piston 172 into which the third piston recess 274 is formed.

Configuration of the housing recess 288 enables, as seen in FIG. 8, 195° rotational movement of the second piston 172 and hence the pressure chamber 274 formed therein. Surfaces or walls 294 and 296 of the central housing recess 288 function as stops for the piston vane 286 to thereby limit rotational movement of the second piston. First and second pressure channels or apertures 298 and 300, formed in the housing 182 communicate with the recess 288 through the surfaces 294 and 296, respectively. Inlet ends of the housing apertures 298 and 300 have respectively connected thereto the third and fourth pressure lines 194 and 196 from the control means 18.

When pressurized fluid is applied through the line 194, the second piston 172 is rotated (direction of Arrow "A", FIG. 8(*a*)) to, and is maintained in, its extreme clockwise position, with the piston vane 286 in abutment with the recess surface 294.

Since the third piston 174 is interconnected with the first piston 170, through the locking pawls 228, the drive member 214, the rotor hub 204, the rotor shaft 44 and the shaft extension 176, clockwise rotation of the first and second pistons 170 ahd 172 causes simultaneous clockwise rotation of the pressure chamber 274 formed in the second piston and of the third piston. At the extreme clockwise positions of both the second and third pistons 172 and 174, a vane 302 of the third piston is positioned just clockwise (FIG. 9(*a*)) of the gas pressure inlet 278. This enables barrel gas pressure from the inlet 278, during firing of the gun 16, to cause clockwise rotation of the third piston and hence clockwise shell feeding rotation of the rotor 24 for feeding from the first shell supply 12.

During subsequent operation of the third piston 172, pressure chamber inner surfaces 304 and 306, at opposite end regions of the pressure chamber 288 limit rotational movement of the third piston vane to 135°, for reasons discussed below.

To change between feeding from the first shell supply 12 to the second shell supply 14, fluid pressure is applied through the fourth line 196 and the aperture 300 (FIG. 8(*b*)) into the valve recess 288. This rotates the second piston 172 195° fully counterclockwise (direction of Arrow "B") until the vane 286 abuts the recess surface 294. At the same time, the first and third pistons 170 and 174 are rotated through 60° counterclockwise (direction of Arrow "B", FIG. 9(*b*)) by pressure applied in the second line 192.

As shown in FIG. 9(*b*), this simultaneous, combined 195° counterclockwise movement of the second piston 172, including the pressure chamber 274, and 60° counterclockwise movement of the third piston 174 positions the third piston vane 302 just counterclockwise of the gas pressure inlet 278. Accordingly, the third piston 274 is set to cause, responsive to pressurized barrel gas from the inlet 278, counterclockwise rotation of the rotor 24 during subsequent firing, as is required to feed shells from the second supply 14.

Pressure sealing between the central housing recess 288 and the second piston 272 is by generally conventional means, including seals 308 attached to sides of the second piston vane 286 (FIG. 8) and peripheral "O" ring seals 310 between the housing 182 and the second piston (FIG. 4).

As shown in FIG. 10, the selector control 18, which provides fluid under pressure to the central housing 182 to operate the first and second pistons 170 and 172, includes an electrically operated solenoid valve 318 controlled by a two piston electrical selector switch 320. Pressurized fluid is supplied to the valve 318, through a pressure line 322, from a fluid pressure source 324. Assuming, for example, the associated weapons system utilizes hydraulic pressure for gun movement, the source 324 may comprise the weapons system hydraulic pump or pressure accumulator (not shown).

In a first position of the switch 320, the solenoid valve 318 is actuated to provide pressurized fluid to both the lines 190 and 194, to cause clockwise movement of the rotary pistons 170, 172 and 174. Hence, when the switch 320 is in the first switch position, the shell feeding apparatus 10 is operative for feeding the shells 20 from the first shell supply 12.

When the switch 320 is in a second position for selecting feeding the shells 22 from the second supply 14, pressurized fluid is provided to the lines 192 and 196 to cause counterclockwise rotational movement of pistons 170, 172 and 174.

During firing of the gun 16, the rotor 24 is indexed 120° immediately after each firing by pressurized barrel gas fed to the pressure inlet 278 (FIG. 9) of the rotor control and drive means 34 through the line 178 (FIGS. 1, 2 and 4). Within the control and drive means 34, the pressurized barrel gas rotatably drives the third, rotor drive piston 174 which, by being fixed to the rotor shaft extension 176, rotatably drives the first stage rotor 24. In turn, the rotor shaft 44 actuates the second stage feeder 36, through the actuation means 42.

Although configured for bidirectional rotation to enable shells to be fed from either of the shell supplies 12 and 14, as long as shells are fed from a selected one of the shell supplies 12 and 14, the rotor 24 is unidirectionally indexed. However, since the third, rotor drive piston 174 is configured for bidirectional reciprocation with each shell fired a ratcheting interconnection is made between the rotor drive piston 174 and the rotor 24, such that with each reciprocating cycle of the drive piston, the rotor is unidirectionally indexed one 120° increment.

Furthermore, since for reliable stripping of shells from whichever rotor cavity is indexed into the shell pick up position 28 and for reliable loading of shells from the supplies 12 and 14 into the rotor 24, the rotor 24 is locked against rotation after each rotor indexing step. Thus, rotor locking and unlocking is provided.

These two important functions of rotor locking/unlocking and rotor ratcheting are provided in the rotor control and drive means 34 by the rotor locking and ratchet means 198 (FIGS. 2, 4, 11–13) which include related portions of the rotor shaft extension 176.

Locking of the rotor 24 against rotation in either direction, at each rotor indexing step, is provided, as above described, and as also shown in FIG. 12, by the locking pawls 228. When the pawl hook ends 232 are in engagement with the rotor drive member peripheral grooves 226, which are spaced at 120° rotor indexing intervals, the rotor 24 is nonrotatably locked to the first rotary piston 170. In operation, the first piston 170 is nonrotatably locked to the fixed central housing 182 by fluid pressure applied by either of the lines 190 or 192, according to shell supply selected.

To enable 120° shell feeding rotor indexing during firing of the gun 16, an appropriate one of the locking pawls hooks 232 is disengaged from its associated drive member groove 226. This is accomplished through a spring loaded detent pin 330 installed at a forward region of each of the locking pawls 228, forwardly of the drive member 214. The detent pins 330 are configured relatively to the pawls 228 such that free, lower ends of the detent pins are normally radially adjacent to a locally enlarged diameter region 332 of the rotor shaft extension 176. This shaft region 332 is formed with a radially projecting, arcuate, camming portion 334 having an angular width selected to cause opposite side surfaces 336 and 338 thereof to contact or be closely adjacent to corresponding side regions of the detent pins 330 when the camming portion is centered between the locking pawls 228 and the locking pawl hooks 232 fully engage corresponding ones of the drive member grooves 226.

As more particularly described below, when the shaft extension 176 is rotated through a small angle in either direction from this camming portion centered position, one of the side surfaces 336 and 338, according to rotational direction, pushing outwardly on the adjacent detent pin 330. This causes the associated locking pawl 228 to pivot an amount sufficient to disengage the hook 232 of that pawl from its engaged drive member groove 226. This enables, as the opposite pawl hook 232 ramps up out of its engaged drive member groove 226, the drive member 214, and hence the rotor 24, to rotate with the shaft extension 176. Initial, partial rotation of the shaft extension 176, in response to firing of the gun 16, thus is operative for causing unlocking of the rotor 24. As the shaft extension 176 subsequently return rotates closely to its initial position, the camming portion 334 depresses whichever one of the detent pins 330 is engaged to permit the camming portion to be recentered between the detent pins 330.

During initial, rotor unlocking rotation of the shaft extension 176, the shaft extension is not yet in driving engagement with the drive member 214. After the drive member 214 is unlocked, the shaft extension 176 drivingly engages, through the drive member 214, the rotor 24 for causing 120° shell feeding indexing of the rotor. When the rotor 24 has been fully indexed, the shaft extension 176 disengages from the rotor drive member 214 for shaft return rotation by the coaxial return spring 346 (FIG. 4).

Disengageable driving of the rotor drive member 214, and thus the rotor 24, by the shaft extension 176 is enabled by drive means 340 disposed through a transverse aperture 342 formed in a locally enlarged shaft extension region 344, FIGS. 3, 4, 12 and 13. On assembly, the shaft extension region 344 is axially located with the drive means 340, which also forms part of the rotor locking and ratchet means 198, positioned inside a cylindrical recess 346 defined inside the rotor drive member forward portion 216.

Comprising the drive means 340 is an opposed pair of rotor drive member engaging and driving elements 348, which are outwardly biased towards an adjacent inner side wall 350 of the recess 346 by internally disposed spring means 352. A pair of transversely spaced apart, longitudinally oriented pins 360 retain the elements 348 and spring means 352 in the shaft extension aperture 342.

Formed radially inwardly into the drive member recess side wall 350 are three generally arcuate, longitudinal grooves or recesses 362. Such recesses 362 are spaced apart at 120° intervals and are centered between the outer grooves 226.

At specific rotational positions of the shaft extension 176 relative to the drive member 214, the driving elements 348 drivingly engage the drive member by projecting into the inner grooves 362. Configuration and location of the drive means 340 relative to the grooves 362 enables only one of the driving elements 348 at a time to engage the drive member grooves. Thus, when one of the elements 348 is partially received into one of the grooves, the other element is in sliding contact with the side wall 350.

Outer ends of each of the driving elements 348 are formed having a flat lower (as seen in FIG. 12) driving surface 364 and an upper, inwardly beveled ramping surface 366. As a consequence, each of the driving elements 348 is operative for driving the rotor drive member 214 in a single rotational direction, corresponding to rotational direction of the shaft extension 176. As an illustration, when the shaft extension 176 is rotated clockwise (direction of Arrow "A", FIG. 12(*a*)), the right hand one of the elements 348, by engagement with an adjacent one of the drive member grooves 362, drives the rotor drive member 214 clockwise. When the shaft extension 176 is rotated counterclockwise (direction of Arrow "B", FIG. 12(*b*)) the left hand element 348 drives the drive member 214 counterclockwise.

In both these situations, whichever one of the driving elements 348 that is not in actual driving engagement with the drive member 214 ramps inwardly out of its associated drive member groove 362 as driving engagement by the other element is established.

For either direction of rotor shaft extension rotation, one of the driving elements 348 engages and rotatably drives the rotor drive member 214 in the same rotational direction, as is necessary to enable shell feeding from either of the shells supplies 12 and 14. Means are therefore provided for preventing driving engagement by whichever one of the drive elements would otherwise drive the drive member 214 when the shaft extension 176 is return rotated by the rotor spring 336 after each firing.

To enable preventing of driving engagement between the driving elements 348 and the rotor drive member 214, during shaft extension return rotation, each of the elements has an ear 372 (FIGS. 4 and 13) projecting forwardly from an outer end thereof towards a corresponding ear 374 projecting rearwardly from the first piston wall 246. Relative configuration of the driving element ears 372 and the corresponding first piston ear 374 causes, when either of the driving elements 348 is rotated by the shaft extension 176 into adjacency with the first piston ear, interference by the piston ear with outward movement of the element. This prevents driving engagement between the interfered with element 348 and whichever one of the drive member grooves 346 is adjacent thereto, return rotation of the shaft extension being enabled without rotor rotation. Because the shaft extension 176 is reciprocatingly rotated, relative configuration of the shaft extension, the drive elements 348, the drive member 214 and the first piston 170 causes whichever driving element is to be interfered with to be at the same rotational position, corresponding to position of the interfering piston ear 374, each firing cycle.

OPERATION

Although operation of the dual, two stage shell feeding apparatus 10 has been generally described, or is generally apparent from the above description, for purposes of clarity, significant aspects of the operation, in particular of the rotor control and drive means 34, are described hereafter in conjunction with FIGS. 14–18. These figures, which represent a time sequence of relative positions before and after firing of the gun 16, directly relate position or orientation of such parts of the apparatus 10 as the shaft extension 176, the first piston 170, the driving elements 348, the locking pawls 228, the rotor 24 and the actuator member 136 to position or orientation of the second and third pistons 172 and 174. As such, FIGS. 14–18 depict a series of relative positions of the shaft extension 176, the rotor 24 and so forth as the third, drive piston 174 is driven by pressurized barrel gases, caused by firing of the gun 16, from an initial, prefiring condition through 135° of rotation, and as the third piston is then return rotated.

For illustrative purposes, FIGS. 14–18 depict the apparatus 10 operated by the selector control means 18 for feeding the shells 20 from the first shell supply 12. In this regard, it is emphasized that FIGS. 14(*b*)–18(*b*) are transverse cross sectional views looking rearwardly, whereas the similar previously described views were taken looking forwardly. This difference in viewing direction enables showing of portions of the apparatus 10 otherwise not visible, thereby enabling showing of relative positions.

In FIG. 14(*a*), the second and third pistons 172 and 174 are shown rotated (direction of Arrow "A") to fully clockwise, prefiring positions. Accordingly, the third, rotor drive piston 174 is set for clockwise rotation in response to pressurized barrel gases, caused by firing of the gun 16, being fed, through the inlet 278, into the pressure chamber 274, formed in the second piston 172. As such, FIG. 14(*a*) corresponds directly to FIG. 9(*a*), being presented for ready comparison with FIG. 14(*b*). In response to pressure from the control means 18, the first piston 170 (FIG. 14(*b*)) is also rotated (direction of Arrow "A") to a fully clockwise prefiring position. Because the rotor drive member 214 is locked to the first piston 170, the rotor 24 is positioned so that a first one of the rotor held shells 20 (Shell No. 1) is in the pick up position 28. The third one of the rotor held shells 20 (Shell No. 3) is thus positioned at the first supply means outfeed portion 60, the second one of the rotor held shells (Shell No. 2) being positioned between the first and third shells. As drawn, FIG. 14(*b*) is generally a composite of FIGS. 5(*a*), 6(*a*), 11(*a*) and 12(*a*), but looking in the opposite direction.

In the prefiring orientation shown, neither of the driving elements 348 are yet engaged with the drive member grooves 362, and the shaft extension camming portion 334 is centered between the locking pawl detent pins 330. Also, the second stage actuation member 136 is in a centered position. The bolt assembly 98 (FIG. 1) is assumed to be seared up rearwardly of the first shell 20 in the pick up position 28.

When the bolt assembly 98 is unseared for firing the gun 16, the forwardly moving bolt (driven by drive springs, not shown) strips Shell No. 1 from the pick up position 28, loading it forwardly into the breech 104 and firing it. High pressure barrel gas, caused by the firing and directed to the inlet 278 of second piston pressure chamber 274 (FIG. 15(*a*)), acts against the third piston vane 302, causing clockwise rotation (Arrow "A") of third piston, and with it the rotor shaft extension 176.

As the third piston 174 and the shaft extension 176, rotate clockwise through an initial 15°, the shaft extension camming portion 334 pushes against the adjacent detent pin 330, pivoting the associated locking pawl 228 outwardly (direction of Arrow "G", FIG. 15(*b*)) about its mounting pin 230. This withdraws the hook 232 of that locking pawl from the adjacent drive member recess 226. Simultaneously, one of the shaft extension mounted driving elements 348 extends, under spring action, outwardly (direction of Arrow "H") into an adjacent one of the drive member inner grooves 362 to enable driving of the drive member 214.

Although both the rotor unlocking and driving element engagement occur during the first 15° of shaft extension rotation, rotor rotation does not yet start. Thus, no outward movement of the second stage actuation element 136 yet occurs.

When rotation of the third piston 174 and the shaft extension 176 exceeds 15° (FIG. 16(*a*)), the rotor 24 is driven in a clockwise direction (Arrow "A", FIG. 16(*b*)). This rotatably advances the second shell 20 (Shell No. 2) towards the pick up position 28 and the empty rotor cavity 54, from which Shell No. 1 was just stripped, towards the first shell supply outfeed portion 60. As clockwise rotation of the rotor 24 is started, the hook 232 of the still unreleased locking pawl 228 is ramped out of its engaged drive member recess 226, pivoting the locking pawl outwardly (direction of Arrow "J") about its mounting pin 230. Both the locking pawl hooks 232 then slide along an adjacent drive member outer surface 374.

As the rotor 24 rotates through 60°, towards an intermediate, 90° rotational position of FIG. 16(*b*), one of the shells 22 is rotated through the shell pick up position 28.

Rotation of the rotor shaft 44 with the shaft extension 176 causes outward movement of the actuating member 136 (Arrow "D"), thereby outwardly moving the shell supply sliding track 114 and compressing the associated slide driving springs 120 to prepare for subsequent second stage shell advancement towards the rotor 24.

Upon full 120° clockwise rotor rotation (FIG. 17(*b*)), the second shell 20 (Shell No. 2) is indexed into the pick up position 28. The empty rotor cavity 54, from which the first shell 20 (Shell No. 1) was just stripped, is correspondingly indexed with the first shell supply outfeed portion 60, waiting for a shell to be advanced thereinto by the now fully outwardly moved sliding track 114. This 120° rotor rotation corresponds to 135° clockwise rotation of the drive piston 174 (Arrow "A", FIG. 17(*a*)), including the initial 15°, rotor unlocking rotation.

As the rotor 24 closely approaches its full 120° rotational step, two of the drive member outer recesses 226 rotate into the region of the locking pawl hooks 232. By urging of the springs 254, the locking pawl hooks 232 snap into these recesses 226 to again lock the rotor against rotation. As this occurs, the locking pawls 228 pivot about the mounting pins 230 in the direction of Arrow "K" and "L" (FIG. 17(*b*)).

Barrel gas venting means (not shown), which may be of conventional configuration, are preferably provided to vent pressurized barrel gas from the second piston pressure chamber 274 at the instant the third piston 174 is fully clockwise rotated. This enables the rotor return spring 336 to immediately return rotate the rotor shaft 44, the shaft extension 176, and the third piston 174, causing recentering of the actuation member 136. The springs 120 driving the shell supply sliding track 114 inwardly in the shell advancing direction are thus not required to expend shell advancing energy in rotor shaft return rotation, which would tend to slow second stage shell feeding.

As shown in FIG. 13, when the rotor shaft extension 176 reaches its full 135° rotational position of FIG. 17(*b*), the ear 372 of the nonengaged one of the driving elements 348 moves into interfering relationship with the first piston ear 374, preventing that element from drivingly engaging the adjacent drive member groove 236, as would otherwise occur. If such driving element engagement with the adjacent drive member groove 236 were not prevented, no return rotation of the shaft extension 176, or the third, drive piston 174, would be possible, due to the drive member 214 having been relocked against any rotation movement.

Partial counterclockwise return rotation due to driving action of the return spring 46 of the third, drive piston 174 (direction of Arrow "B") is depicted in FIG. 18(*a*). As the rotor shaft extension 176 correspondingly return rotates (FIG. 18(*b*)), with ends of the rotor driving elements 348 sliding along the drive member inner wall 350, the extension shaft camming portion 334 engages and causes retraction (Arrow "M") of an adjacent one of the detent pins 330. This enables, as the shaft extension return rotates to the initial, prefiring orientation of FIG. 14(*b*), the camming portion 334 to slide past the engaged detent pin 330 and recenter between the two detent pins.

During this return rotation of the shaft extension 176 and the drive piston 174 in preparation for a next firing, the shell supply sliding track 114, under driving action of the springs 120, advances the end one of the shells 20 (Shell No. 4) into the adjacent empty rotor cavity 54, thereby again completely filling the rotor 24 with shells. Accordingly, if the bolt assembly 98 is researed, the fully loaded rotor 24 is in readiness for shifting for feeding from the second shell supply 14 and subsequent shifting back to feeding from the first shell supply.

By way of general summary, FIG. 19 plots relative linear or angular displacement of the bolt 98, the third, drive piston 174, the rotor shaft extension 176, the rotor shaft 44, the rotor drive member 214, the rotor 24, the second stage actuation member 136 and the second stage sliding track 114 for an exemplary 35 mm automatic cannon. Displacement of such portions of the dual shell feeding apparatus 10 is plotted against an approximate time after firing of the exemplary cannon, a firing rate of 600 rounds per minute, allowing 100 m seconds per shot, being assumed.

As can be seen from FIGS. 19(*a*) and 19(*b*), rotation of the drive piston 174, shaft extension 176 and rotor shaft 44 starts immediately after firing, before bolt unlocking from the breech occurs. Complete 135°, one way rotation of these elements is typically completed about 20–25 m seconds after firing. It follows that 120° rotor rotation (FIG. 19(*c*)), and thus the first stage shell feeding, is also completed in this time range, which is ordinarily substantially before the time, at about 50 m seconds after firing, the bolt assembly completes recoiling and starts counterrecoiling back towards the shell indexed in the pick up position 28. Because one of the shells being fed is typically indexed into the pick up position 28 well in advance of when the bolt 98 reaching the pick up position or counterrecoil, availability of a shell to the bolt is assured, even under such adverse conditions as a dirty or poorly lubricated gun.

Linear displacement of the second stage actuation member 136, as a result of being interconnected with the rotor shaft 128, directly follows shaft rotational displacement (FIGS. 19(*b*) and 19(*d*)). However, due to the mass of the shells being advanced by the second stage sliding track 114, shell advancing return travel of the track is seen from FIG. 19(*e*) to lag return travel of the actuation member 136. Accordingly, the actuation member 136 is out of the way of the track 114 and does not inhibit shell advancing movement thereof.

As is seen in FIG. 19(*e*), the time required for return travel of the sliding track 114, which provides second stage shell feeding into the rotor 24, depends upon the number of shells drivingly engaged by the track. Thus, the greater the number of shells engaged, the slower the shell advancing return travel of the track 114. For example, assuming a 35 mm cannon using shells weighing about 3.5 pounds each, when ten shells are drivingly engaged by the track 114, the second stage shell feeding is completed about 80 to 90 m seconds after firing. Thus, a longer time is ordinarily required, and is available, for the second stage shell feeding operation.

Although there has been described above a specific arrangement of a dual, two stage shell feeding apparatus 10 for use with automatic cannon and the like, in accordance with the invention for purposes of illustrating the manner in which the invention may be used to advantage, it will be appreciated that the invention is not limited thereto.

As an example, electrically operated motors may be used in place of the pressure actuated first and second pistons 170 and 172 to cause prefiring rotor orientation for feeding from the first or second shell supplies 12 and 14 and for establishing direction of rotor rotation during shell advancing. Use of electrical motors for these purposes may be advantageous in the absence of a pressurized fluid (or gas) in the weapons system, such as when the gun 16 is electrically driven rather than hydraulically driven.

Also, means for causing shell feeding indexing of the rotor 24, alternative to the barrel gas operated drive piston 174, may be utilized. Although the barrel gas operated piston 174 has the advantages of operating the apparatus 10 in automatic synchronization with firing of the gun 16, since the barrel gas pressure is caused by the firing, and without auxiliary driving force being required, such external drives as an electric motor may alternatively be used to reciprocatingly drive the rotor shaft for first stage shell feeding.

Accordingly, any and all such modifications, variations or equivalent arrangements, as well as others which may occur to those skilled in the art, should be considered to be within the scope of the invention as defined in the appended claims.

I claim:

1. Dual, two stage shell feeding apparatus for guns having associated therewith spaced apart first and second shell supplies and having a shell loading position, the shell feeding apparatus comprising:

(a) a first stage shell transfer rotor having means defining a plurality of peripheral shell holding cavities, the shell rotor cavity defining means defining a first set of cavities, comprising a plurality of first shell holding cavities, for transferring shells from the first shell supply to the loading position and a second set of cavities, comprising a plurality of second shell holding cavities, for transferring shells from the second shell supply to the loading position, said first and second shell holding cavities being alternatively arranged around the rotor;

(b) means rotatably mounting the rotor between the first and second shell supplies and the shell loading position to enable rotational transfer of shells from each one of the shell supplies to the shell loading position, said mounting means mounting the rotor relative to the first and second shell supplies and the shell loading position to cause, whenever one of the rotor cavities is in shell receiving relationship with a selected one of the shell supplies, another one of the cavities to be in the shell loading position;

(c) means for rotatably indexing the rotor in one rotational direction to transfer shells from the first shell supply to the shell loading position and in an opposite rotational direction to transfer shells from the second shell supply to the shell loading position, said rotor indexing means including selector means for selecting between the sets of cavities to be used for shell transferring and hence for selecting between feeding from the two shell supplies; and, (d) second stage means for transferring shells from said shell supplies into the rotor cavities.

2. The dual, two stage shell feeding apparatus according to claim 1, wherein the rotor and the rotor mounting means are configured to cause, whenever one of the first rotor cavities is indexed into the shell loading position, another one of the first cavities to be in shell receiving relationship with the first shell supply and whenever one of the second rotor cavities is indexed into the shell loading position another one of the second rotor cavities to be in shell receiving relationship with the second shell supply.

3. The dual, two stage shell feeding apparatus according to claim 1, wherein said second stage means is operative, during firing of the cannon, for transferring a shell from the first shell supply into the rotor whenever an empty one of the first rotor cavities is in shell receiving relationship with the first shell supply and for transferring a shell from the second shell supply into the rotor whenever an empty one of the second rotor cavities is in shell receiving relationship with the second shell supply.

4. Dual, two stage shell feeding apparatus for guns having associated therewith spaced apart first and second shell supplies, a shell loading position and means for moving shells from the loading position into a gun breech for firing, said feeding apparatus comprising:

(a) a first stage shell rotor having means defining first and second sets of peripheral shell holding cavities, said first set including a plurality of first shell cavities and said second set including a plurality of second cavities, said first and second cavities being arranged in alternating relationship around the rotor;

(b) means mounting, for bidirectional rotation, the rotor between the first and second shell supplies and the shell loading position, relative positioning between the shell supplies, the loading position and the rotor causing, whenever one of the first rotor cavities is in the shell loading position, another one of the first rotor cavities to be in shell receiving relationship with the first shell supply and, whenever one of the second rotor cavities is in the shell loading position, another one of the second rotor cavities to be in shell receiving relationship with the second shell supply;

(c) means for selecting between feeding the gun from the first and second set of rotor cavities, thereby selecting between feeding the gun from the first and second shell supplies;

(d) means for rotatably indexing the rotor, between each shell firing, to index a shell in one of the selected set of rotor cavities into the shell loading position and an empty one of the selected set of rotor cavities into shell receiving relationship with the corresponding shell supply, said rotor rotating means rotating the rotor in one direction to feed the gun from one of the shell supplies and in an opposite direction to feed the gun from the other shell supply; and (e) second stage means for transferring, between each shell firing, a shell from said corresponding shell supply into said empty one of the selected set of rotor cavities.

5. The dual, two stage shell feeding apparatus according to claim 5, wherein the first and second rotor cavities are spaced around the rotor at equal angular spacings, and wherein said selecting means include means for causing selective rotation of the rotor, before firing the gun, through a rotational angle equal to said angular spacing between rotor cavities.

6. The dual, two stage shell feeding apparatus according to claim 5, wherein said means for causing selective rotation of the rotor through a rotational angle equal to the angular spacing between rotor cavities is configured for simultaneously establishing the shell transferring rotational direction of the rotor during firing of the gun.

7. Dual, two stage shell feeding apparatus for guns having associated therewith spaced apart first and second shell supplies, a shell loading position and means for moving shells from the loading position into a gun breech for firing, said feeding apparatus comprising:

(a) a first stage shell rotor having means defining a plurality of alternating first and second peripheral shell holding cavities spaced apart at equal angular intervals;

(b) means rotatably mounting the rotor between the first and second shell supplies and the shell loading position, relative positioning between the shell supplies, the loading position and the rotor causing, whenever one of the first rotor cavities is in the shell loading position, another one of the first rotor cavities to be in shell receiving relationship with the first shell supply and, whenever one of the second rotor cavities is in the shell loading position, another one of the second rotor cavities to be in shell receiving relationship with the second shell supply;

(c) means for selecting between feeding the gun from the first and second rotor cavities, including means for rotating the rotor, during non-firing of the gun, through a rotational angle equal to the angular interval between rotor cavities and for establishing direction of rotor rotation during firing of the gun;

(d) means for rotatably indexing the rotor, between each shell firing, through a rotational angle equal to twice the angular interval between the rotor cavities, to index a shell in one of the cavities selected for feeding into the shell loading position and an adjacent empty one of the cavities selected for feeding into shell receiving relationship with the corresponding shell supply, said rotor rotating means rotating the rotor in one direction when feeding the gun from the first set of rotor cavities and in an opposite direction when feeding the gun from the second set of rotor cavities; and (e) second stage means for transferring, between each shell firing, a shell from said corresponding shell supply into said empty one of the selected set of rotor cavities in shell receiving relationship therewith.

8. The dual, two stage shell feeding apparatus according to claim 7, wherein said cavity selecting and rotor direction establishing means includes first and second rotary pistons and pressurized fluid means for selectively causing rotation of said pistons, said first piston being configured and operative for rotationally indexing the rotor in either direction to select between shell feeding by the first and second rotor cavities and said second rotary piston being configured and operative for establishing rotor rotational indexing direction during shell feeding.

9. The dual, two stage shell feeding apparatus according to claim 7, wherein the rotor rotating means includes a rotary drive piston, means interconnecting said piston with said rotor and means for supplying pressurized barrel gas, caused by firing of the gun, to said rotary piston to thereby cause rotor shell feeding rotation.

10. The dual, two stage shell feeding apparatus according to claim 9, wherein said means interconnecting the rotary drive piston with the rotor includes ratcheting means enabling unidirectional shell feeding rotor indexing and bidirectional, reciprocating movement of the rotary piston responsive to firing of the gun.

11. The dual, two stage shell feeding apparatus according to claim 9, wherein said means interconnecting the rotary drive piston to the rotor includes means enabling releasable, non-rotatably locking of the rotor at each shell feeding indexing step thereof.

12. The dual, two stage shell feeding apparatus according to claim 9, including means interconnecting said rotary drive piston to said second stage shell transferring means, said second stage shell transferring means being thereby also responsive to firing of the gun.

13. The dual, two stage shell feeding apparatus according to claims 1, 4 or 7, wherein both the means for rotatably indexing the first stage rotor and the second stage shell transferring means are responsive to firing of the gun, and wherein said means for rotatably indexing the rotor is operative for causing, in response to firing of the gun, first stage shell feeding indexing of the rotor before the second stage shell transferring means causes shell transferring into the rotor from the shell supplies.

14. Dual, two stage shell feeding apparatus for a gun having first and second spaced apart shell supplies and a shell loading position, said shell feeding apparatus comprising:

(a) a generally cylindrical first stage shell rotor having three first and three second peripheral shell holding cavities, said first and second cavities being alternately arranged at 60° intervals around the rotor;

(b) means bidirectionally, rotatably mounting the rotor between the shell supplies and the shell loading position so that, when one of the first cavities is indexed into the shell loading position, another one of the first cavities is in shell receiving relationship with the first shell supply and, when one of the second cavities is indexed into the shell loading position, another one of the second cavities is in shell receiving relationship with the second shell supply;

(c) means for indexing the rotor before firing the gun to selectively index one of the first or second cavities into the shell loading position to select from which one of the shell supplies the gun is to be fed and for setting direction of shell transferring rotor rotation during firing of the gun;

(d) means responsive to firing the gun for indexing the rotor 120° in one rotational direction when the first shell supply is selected for feeding the gun and in the opposite rotational direction when the second shell supply is selected for feeding the gun; and (e) second stage means responsive to said 120° rotor indexing means for transferring, after each 120° shell feeding rotor indexing, a shell from the selected shell supply into the rotor.

15. The dual, two stage shell feeding apparatus according to claim 14, wherein the prefiring rotor indexing means includes bidirectional first rotary piston means for indexing the rotor and bidirectional second rotary piston means for setting direction of rotor 120° shell feeding indexing during firing of the gun, and wherein the 120° rotor indexing means includes bidirectional third rotary piston means responsive to firing of the gun for causing 120° shell feeding, rotor indexing between firings.

16. The dual, two stage shell feeding apparatus according to claim 15, including pressurized fluid means for selective actuating said first and second rotary pistons according to the shell supply from which the gun is to be fed and including means for supplying pressurized barrel gas, caused by firing of the gun, to said third rotary piston.

17. Dual, two stage shell feeding apparatus for automatic cannon and the like, which comprises:

(a) first and second separate shell supplies adapted for containing shells to be fired by the cannon;

(b) a first stage shell transferring rotor having means defining a plurality of first peripheral shell holding cavities and a like plurality of second shell holding cavities, said first and second cavities being arranged in alternating relationship at equal angular spacings around the rotor;

(c) means positioning the first and second shell supplies and rotatably mounting the rotor relative to a shell loading position of the cannon to cause, whenever one of the first rotor cavities is indexed into the shell loading position another one of the first rotor cavities to be in shell receiving relationship with the corresponding first shell supply and to cause, whenever one of the second rotor cavities is indexed into the shell loading position, another one of the second rotor cavities to be in shell receiving relationship with the corresponding shell supply;

(d) rotor directional rotation control and rotor drive means connected to the rotor for selectively causing prefiring indexing of the rotor to index one of the rotor cavities, corresponding to whichever one of the shell supply is selected for feeding the cannon into the shell loading position, for selectively causing prefiring setting of rotor direction of rotation for shell feeding during firing and for causing rotationally indexing the rotor, between each firing, in the set rotor rotational direction, to advance shells from the selected shell supply into the loading position; and (e) second stage shell transferring means associated with each of the shell supplies for transferring, between each firing and after rotor shell advancing indexing, a shell from the selected shell supply into an empty one of the corresponding shell cavities.

18. The dual, two stage shell feeding apparatus according to claim 17, wherein the rotor directional rotation control and rotor drive means includes:

(a) first bidirectional rotary piston means for prefiring indexing of rotor to shift between positioning ones of the first and second cavities in the loading position;

(b) second bidirectional rotary piston means for setting rotational, shell transferring indexing direction of the rotor during firing;

(c) selective control means for providing pressurized fluid to the first and second rotary piston means for selective rotational operation thereof; and (d) third, bidirectional rotary piston means, responsive to pressurized barrel gas caused by firing the cannon, for causing shell transferring rotational indexing of the rotor during firing.

19. The dual, two stage shell feeding apparatus according to claim 18, wherein the rotor mounting means includes a rotor shaft disposed axially through the rotor and having a shaft extension projecting axially therefrom, and wherein the first and second rotary pistons are rotatably disposed around the shaft extension and the third rotary piston is non-rotatably fixed to the shaft extension.

20. The dual, two stage shell feeding apparatus according to claim 19, wherein the rotor directional rotation control and rotor drive means includes releasable locking means for rotatably locking the rotor to the first rotary piston means during prefiring, rotor indexing to select between feeding from the shell supplies and also whenever one of the corresponding rotor cavities is indexed into the shell loading position, and for rotatably unlocking the rotor from the first rotary piston during shell transferring rotor rotation between firings of the cannon.

21. The dual, two stage shell feeding apparatus according to claim 19, wherein the second rotary piston means includes means defining a generally hemicylindrical pressure chamber configured for receiving therein the third rotary piston, prefiring rotation of the second piston means to set rotor rotational direction thereby rotating the pressure chamber relative to the third rotary piston.

22. The dual, two stage shell feeding apparatus according to claim 19, wherein the rotor directional rotation control and rotor drive means includes ratcheting means interconnecting the shaft extension with the rotor for enabling, stepwise unidirectional rotor indexing during continuous firing of the cannon, while feeding from a selected one of the shell supplies, in response to rotor advancing rotation of the third rotary piston, while also enabling return rotation of the third piston and shaft extension between firings, and including means for causing said return rotation.

23. The dual, two stage shell feeding apparatus according to claim 19, including actuation means for said second stage shell transferring means, said actuation means being connected to the rotor shaft and responsive to rotation thereof.

24. The dual, two stage shell feeding apparatus according to claim 23, wherein said second stage shell transferring means comprises a spring driven shell advancing track and wherein said actuation means includes a track actuating member configured and operative for causing, responsive to shell advancing rotation of the rotor shaft during firing of the cannon, movement of said shell advancing track away from the rotor to thereby compresses springs for driving the track, the springs being subsequently operative for driving the track in a shell transferring direction back towards the rotor after the track actuating member has been returned by return rotation of the rotor shaft.

* * * * *

UNITED STATES PATENT AND TRADEMARK OFFICE

CERTIFICATE OF CORRECTION

PATENT NO. : 4,311,081

DATED : January 19, 1982

INVENTOR(S) : Richard R. Gillum

It is certified that error appears in the above—identified patent and that said Letters Patent is hereby corrected as shown below:

In column 17, line 14 change "ahd" to --and--

In column 17, line 60 change "piston" to --position--

In column 26, line 11 change "5" to --4--

Signed and Sealed this

*Twenty-ninth* Day of *March 1983*

[SEAL]

*Attest:*

GERALD J. MOSSINGHOFF

*Attesting Officer*

*Commissioner of Patents and Trademarks*